US012516856B2

(12) United States Patent
Butler et al.

(10) Patent No.: US 12,516,856 B2
(45) **Date of Patent: *Jan. 6, 2026**

(54) HYBRID HEAT-PUMP SYSTEM

(71) Applicant: Copeland LP, Sidney, OH (US)

(72) Inventors: Brian R. Butler, Sidney, OH (US); Andrew M. Welch, Franklin, OH (US); David A. Alfano, Sidney, OH (US); Natarajan Rajendran, Centerville, OH (US)

(73) Assignee: Copeland LP, Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/440,449

(22) Filed: Feb. 13, 2024

(65) Prior Publication Data

US 2024/0183584 A1 Jun. 6, 2024

Related U.S. Application Data

(63) Continuation of application No. 17/210,160, filed on Mar. 23, 2021, now Pat. No. 11,940,188.

(51) Int. Cl.
*F25B 30/02* (2006.01)
*F24H 4/02* (2022.01)
(Continued)

(52) U.S. Cl.
CPC ..... *F25B 30/02* (2013.01); *F24H 4/02* (2013.01); *F25B 13/00* (2013.01); *F25B 41/31* (2021.01); *F25B 2313/02742* (2013.01)

(58) Field of Classification Search
CPC ..... F25B 30/02; F25B 41/31; F25B 13/00; F25B 2313/02742; F24H 4/02
See application file for complete search history.

(56) References Cited

U.S. PATENT DOCUMENTS 4,191,023 A 3/1980 Sisk et al.
4,384,608 A 5/1983 Scarlett et al.
(Continued)

FOREIGN PATENT DOCUMENTS

CN 101144662 A 3/2008
CN 106 016 859 A 10/2016
(Continued)

OTHER PUBLICATIONS

Extended European Search Report regarding Application No. 227764990, dated Jan. 24, 2025.
(Continued)

*Primary Examiner* — Larry L Furdge
(74) *Attorney, Agent, or Firm* — Harness, Dickey & Pierce, P.L.C.

(57) ABSTRACT

A heat-pump system includes a compressor, an outdoor heating exchanger, an indoor heat exchanger, an expansion device, and a supplemental heater. The outdoor heat exchanger is in fluid communication with the compressor. The indoor heat exchanger is in fluid communication with the compressor. The expansion device is in fluid communication with the indoor and outdoor heat exchangers. The supplemental heater includes a heat source and a working-fluid conduit. The heat source is in a heat-transfer relationship with the working-fluid conduit such that the heat source is configured to heat the working-fluid conduit. The working-fluid conduit is disposed fluidly between the expansion device and the indoor heat exchanger.

22 Claims, 10 Drawing Sheets

(51) Int. Cl.
*F25B 13/00* (2006.01)
*F25B 41/31* (2021.01)

(56) References Cited

U.S. PATENT DOCUMENTS

| | | | | |
|---|---|---|---|---|
| 4,441,901 | A | 4/1984 | Endoh | |
| 4,716,957 | A | 1/1988 | Thompson et al. | |
| 4,761,964 | A | 8/1988 | Pacheco | |
| 4,805,689 | A | 2/1989 | Inada et al. | |
| 4,921,163 | A | 5/1990 | Viessmann | |
| 5,249,436 | A | 10/1993 | Hemsath | |
| 5,305,822 | A * | 4/1994 | Kogetsu | F24F 3/1405 62/238.7 |
| 5,343,935 | A * | 9/1994 | Sumitani | F24F 3/065 62/238.7 |
| 5,357,781 | A | 10/1994 | Tikijian | |
| 5,473,907 | A | 12/1995 | Briggs | |
| 5,509,274 | A | 4/1996 | Lackstrom | |
| 5,515,689 | A | 5/1996 | Atterbury | |
| 5,634,352 | A | 6/1997 | Nagai et al. | |
| 5,820,262 | A | 10/1998 | Lechner | |
| 5,970,721 | A | 10/1999 | Kamimura et al. | |
| 6,644,047 | B2 | 11/2003 | Taira et al. | |
| 6,655,161 | B1 | 12/2003 | Koo | |
| 6,701,722 | B1 | 3/2004 | Seo et al. | |
| 6,772,598 | B1 | 8/2004 | Rinehart | |
| 6,791,088 | B1 | 9/2004 | Williams, II et al. | |
| 6,868,678 | B2 | 3/2005 | Mei et al. | |
| 6,973,794 | B2 | 12/2005 | Street et al. | |
| 7,197,914 | B2 | 4/2007 | Maresca, Jr. et al. | |
| 7,814,757 | B2 | 10/2010 | Zima et al. | |
| 7,849,700 | B2 | 12/2010 | Seefeldt | |
| 8,215,121 | B2 | 7/2012 | Yoshimi et al. | |
| 8,280,557 | B2 | 10/2012 | Kawano et al. | |
| 8,899,056 | B2 | 12/2014 | Kawano et al. | |
| 8,899,099 | B2 | 12/2014 | Grosse Bley et al. | |
| 8,924,026 | B2 | 12/2014 | Federspiel et al. | |
| 9,222,711 | B2 | 12/2015 | Ochiai et al. | |
| 9,239,183 | B2 | 1/2016 | Amick | |
| 9,353,979 | B2 | 5/2016 | Morimoto et al. | |
| 9,459,032 | B2 | 10/2016 | Nishimura et al. | |
| 9,625,195 | B2 | 4/2017 | Hiraki et al. | |
| 9,739,513 | B2 | 8/2017 | Ochiai et al. | |
| 9,915,450 | B2 | 3/2018 | Seggerman | |
| 9,933,205 | B2 | 4/2018 | Hatomura et al. | |
| 9,970,665 | B2 | 5/2018 | Bush et al. | |
| 10,018,387 | B2 | 7/2018 | Giles et al. | |
| 10,047,990 | B2 | 8/2018 | Marshall et al. | |
| 10,113,763 | B2 | 10/2018 | Ochiai et al. | |
| 10,354,332 | B2 | 7/2019 | Trainor et al. | |
| 10,514,176 | B2 | 12/2019 | Weinert | |
| 10,533,764 | B2 | 1/2020 | Yamada et al. | |
| 10,569,620 | B2 | 2/2020 | Vehr et al. | |
| 10,571,171 | B2 | 2/2020 | Gariety et al. | |
| 10,712,061 | B2 | 7/2020 | Tashiro et al. | |
| 10,941,965 | B2 | 3/2021 | Diemer Lopes | |
| 11,440,449 | B2 * | 9/2022 | Seki | B60N 2/5685 |
| 11,725,857 | B1 | 8/2023 | O'Brien et al. | |
| 2005/0263394 | A1 | 12/2005 | Lewis et al. | |
| 2006/0162351 | A1 | 7/2006 | Yahia | |
| 2006/0196200 | A1 | 9/2006 | Harrod et al. | |
| 2008/0060367 | A1 | 3/2008 | Zima et al. | |
| 2012/0318011 | A1 | 12/2012 | Ochiai et al. | |
| 2016/0109144 | A1 | 4/2016 | Kim et al. | |
| 2016/0153687 | A1 | 6/2016 | Deng | |
| 2016/0167481 | A1 | 6/2016 | Makihara et al. | |
| 2016/0178229 | A1 | 6/2016 | Chen et al. | |
| 2017/0191574 | A1 | 7/2017 | Takamatsu et al. | |
| 2017/0284561 | A1 | 10/2017 | Zahlhaas et al. | |
| 2018/0094844 | A1 | 4/2018 | Suzuki | |
| 2018/0347896 | A1 | 12/2018 | Eddy et al. | |
| 2018/0372354 | A1 | 12/2018 | Brizendine et al. | |
| 2019/0024951 | A1 | 1/2019 | Nishiyama et al. | |
| 2019/0056133 | A1 | 2/2019 | Green et al. | |
| 2019/0128569 | A1 | 5/2019 | Tada et al. | |
| 2019/0170383 | A1 | 6/2019 | Weinert | |
| 2019/0170599 | A1 | 6/2019 | Kester | |
| 2019/0170603 | A1 | 6/2019 | Gupte et al. | |
| 2019/0170604 | A1 | 6/2019 | Kester | |
| 2019/0226705 | A1 | 7/2019 | Sakae et al. | |
| 2019/0242632 | A1 | 8/2019 | Sakae et al. | |
| 2019/0277549 | A1 | 9/2019 | Nishiyama et al. | |
| 2019/0301780 | A1 | 10/2019 | Schmidt et al. | |
| 2019/0331377 | A1 | 10/2019 | Matsuda et al. | |
| 2019/0346187 | A1 | 11/2019 | Lopes et al. | |
| 2019/0368752 | A1 | 12/2019 | Shiohama et al. | |
| 2019/0383526 | A1 | 12/2019 | Nishiyama et al. | |
| 2019/0390876 | A1 | 12/2019 | Matsuda et al. | |
| 2020/0011580 | A1 | 1/2020 | Matsuda et al. | |
| 2020/0033036 | A1 | 1/2020 | Yamada et al. | |
| 2020/0049361 | A1 | 2/2020 | Minamida et al. | |
| 2020/0124306 | A1 | 4/2020 | Kowald et al. | |
| 2020/0166257 | A1 | 5/2020 | Wada et al. | |
| 2020/0271364 | A1 | 8/2020 | Creason | |
| 2020/0326113 | A1 | 10/2020 | Donovan et al. | |

FOREIGN PATENT DOCUMENTS

| | | | |
|---|---|---|---|
| CN | 109983286 | A | 7/2019 |
| CN | 110234943 | A | 9/2019 |
| CN | 110529628 | A | 12/2019 |
| EP | 1970651 | A1 | 9/2008 |
| EP | 3051236 | A1 | 8/2016 |
| EP | 3287720 | A1 | 2/2018 |
| EP | 3358278 | A1 | 8/2018 |
| EP | 3418655 | A1 | 12/2018 |
| EP | 1970651 | B1 | 7/2019 |
| EP | 3569944 | A1 | 11/2019 |
| EP | 3604981 | A1 | 2/2020 |
| EP | 3614070 | A1 | 2/2020 |
| JP | H05346269 | A | 12/1993 |
| JP | H09105536 | A | 4/1997 |
| JP | H11030446 | A | 2/1999 |
| JP | 2001263832 | A | 9/2001 |
| JP | 2005346269 | A | 12/2005 |
| JP | 2006220416 | A | 8/2006 |
| JP | 2012-127519 | A | 7/2012 |
| JP | 6120966 | B2 | 4/2017 |
| JP | 2019027526 | A | 2/2019 |
| KR | 0158993 | B1 | 1/1999 |
| KR | 2005-0089424 | A | 9/2005 |
| KR | 20080090105 | A | 10/2008 |
| KR | 20200001931 | A | 1/2020 |
| WO | 2017058997 | A1 | 4/2017 |
| WO | 2019150462 | A1 | 8/2019 |
| WO | 2019171588 | A1 | 9/2019 |

OTHER PUBLICATIONS

Extended European Search Report regarding Application No. 21867435.6, dated Sep. 12, 2024.

The Engineering Mindset; "Reversing valve—Heat Pump. How it works, Operation."; Jun. 25, 2017, https://www.google.com/url?sa=i&url=https%3A%2F%2Fwww.youtube.com%2Fwatch%3Fv%3Dr8n1_6qmsKQ&psig=AOvVaw3KwtomkGwDJVhbQDjFw8OV&ust=1598627750015000&source=images&cd=vfe&ved=0CAIQjRxqFwoTCNDDvs7Wu-sCFQAAAAAdAAAAABAL.

Examiner-Initiated Interview Summary regarding U.S. Appl. No. 16/940,843 dated Feb. 5, 2021.

Feng, Shaobin, et al. "Review on Smart Gas Sensing Technology," MDPI Journal on Sensors 2019; Basel Switzerland, Published Aug. 30, 2019.

Danfoss Application Guide: "Gas Detection in Refrigeration Systems", 2018.

Nevanda Nano: "Leak Detection Technologies for A2L Refrigerants in HVACR Equipment: Summary of AHRTI Final Report Findings" SM-AN-0012-02.

Islam, Tarikul and Mukjopadhyay, S.C.; "Linearization of the Sensors Characteristics: a review", Exeley International Journal on Smart Sensing and Intelligent Systems Article DOI 10.21307/ijssis-2019-007; Isue 1 Volune 12; 2019.

(56) References Cited

OTHER PUBLICATIONS

Final Office Action regarding U.S. Appl. No. 16/940,843 dated Mar. 18, 2021.
Applicant-Initiated Interview Summary regarding U.S. Appl. No. 16/940,843 dated May 4, 2021.
International Search Report regarding Application No. PCT/US2021/036209 dated Sep. 24, 2021.
Written Opinion of the ISA regarding Application No. PCT/US2021/036209 dated Sep. 24, 2021.
Daikin Altherma Hybrid Heat Pumps, "Deciding Between A Furnace, Heat Pump Or Hybrid: Know What Matters"; Sep. 29, 2021; https://www.daikin.eu/en_us/product-group/hybrid-heat-pump.html.
International Search Report regarding Application No. PCT/US2021/049260 dated Dec. 17, 2021.
Written Opinion of the ISA regarding Application No. PCT/US2021/049260 dated Dec. 17, 2021.
Applicant-Initiated Interview Summary regarding U.S. Appl. No. 16/940,808 dated Jan. 18, 2022.
International Search Report regarding Application No. PCT/US2022/021382 dated Jun. 28, 2022.
Written Opinion of ISA regarding Application No. PCT/US2022/021382 dated Jun. 28, 2022.
Final Office Action regarding U.S. Appl. No. 16/940,808 dated May 26, 2021.
Final Office Action regrding U.S. Appl. No. 16/940,808 dated May 26, 2022.
Applicant-Initiated Interview Summary regarding U.S. Appl. No. 17/019,946 dated Dec. 19, 2022.
Office Action mailed Feb. 16, 2023, in corresponding U.S. Appl. No. 17/210,095.
Office Action mailed Sep. 9, 2022, in corresponding U.S. Appl. No. 16/940,808.
Non-Final Office Action regarding U.S. Appl. No. 17/210,160 dated Apr. 17, 2023.
Final Office Action regarding U.S. Appl. No. 17/210,095 dated May 30, 2023.
Final Office Action regarding U.S. Appl. No. 17/210,160, dated Oct. 17, 2023.
Tatsunori et al., Heating Device, Aug. 24, 2006, JP2006220416A, 2006.
Nakashiro, Cooling and Heating System, Apr. 22, 1997, JPH09105536A, 1997.
Xiong, Dual Purpose Heat Pump Device for Winter and Summer, Mar. 19, 2008, CN 101144662A, 2008.
Notice of Allowance regarding U.S. Appl. No. 17/210,160, dated Dec. 6, 2023.
Non-Final Office Action regarding U.S. Appl. No. 17/210,095, dated Dec. 11, 2023.
Extended European Search Report regarding Application No. 227764933, dated Feb. 10, 2025.
Chinese First Office Action regarding Application No. 202180070765.0, dated Apr. 3, 2025, with English translation.
Korean Office Action regarding Application No. 10-2023-7011459, dated May 8, 2025.

* cited by examiner

HYBRID HEAT-PUMP SYSTEM

CROSS-REFERENCE TO RELATED APPLICATIONS

This application is a continuation of U.S. patent application Ser. No. 17/210,160 filed on Mar. 23, 2021. The entire disclosure of the above application is incorporated herein by reference.

FIELD

The present disclosure relates to a hybrid heat-pump system.

BACKGROUND

This section provides background information related to the present disclosure and is not necessarily prior art.

Heat-pump systems are operable in a heating mode to heat a space and in a cooling mode to cool a space. Traditional heat-pump systems are relatively effective for cooling and are also generally effective for heating in climates that do not regularly experience temperatures below freezing. Furthermore, operating a traditional heat-pump system in cold weather can be expensive, particularly during times of relatively high electrical-energy costs. The present disclosure provides heat-pump systems that can much more effectively heat a home or building in cold-weather climates and can reduce energy costs associated with operating the systems.

SUMMARY

This section provides a general summary of the disclosure and is not a comprehensive disclosure of its full scope or all of its features.

The present disclosure provides a heat-pump system that includes a compressor, an outdoor heating exchanger, an indoor heat exchanger, an expansion device, and a supplemental heater. The outdoor heat exchanger may be in fluid communication with the compressor. The indoor heat exchanger may be in fluid communication with the compressor. The expansion device may be in fluid communication with the indoor and outdoor heat exchangers. The supplemental heater may include a burner and a working-fluid conduit. The burner may be configured to burn a fuel and heat the working-fluid conduit. When the heat-pump system is operating in a heating mode, the indoor heat exchanger may receive working fluid from the working-fluid conduit such that the working fluid flows from an outlet of the working-fluid conduit to an inlet of the indoor heat exchanger without flowing through any one or more of the compressor, the outdoor heat exchanger, and the expansion device.

In some configurations, the heat-pump system of the above paragraph includes a first reversing valve in fluid communication with the compressor, the expansion device, and the indoor and outdoor heat exchangers. The first reversing valve is movable between a first position and a second position. The first reversing valve is in the first position when the heat-pump system is in the heating mode. The first reversing valve is in the second position when the heat-pump system is in a cooling mode.

In some configurations of the heat-pump system of either of the above paragraphs, when the heat-pump system is operating in the cooling mode, the indoor heat exchanger receives working fluid from the working-fluid conduit of the supplemental heater such that the working fluid flows from an outlet of the working-fluid conduit to an inlet of the indoor heat exchanger without flowing through any one or more of the compressor, the outdoor heat exchanger, and the expansion device.

In some configurations of the heat-pump system of any one or more of the above paragraphs, working fluid flows through the indoor heat exchanger in the same direction in the heating and cooling modes, working fluid flows through the outdoor heat exchanger in the same direction in the heating and cooling modes, working fluid flows through the expansion device in the same direction in the heating and cooling modes, and working fluid flows through the working-fluid conduit in the same direction in the heating and cooling modes.

In some configurations, the heat-pump system of any one or more of the above paragraphs includes a second reversing valve in fluid communication with the compressor, the expansion device, and the indoor and outdoor heat exchangers. The second reversing valve is movable between a first position and a second position. The second reversing valve is in the first position when the heat-pump system is in the heating mode. The second reversing valve is in the second position when the heat-pump system is in the cooling mode.

In some configurations, the heat-pump system of any one or more of the above paragraphs includes a first bypass flow path in selective fluid communication with the first and second reversing valves; a first bypass valve fluidly connected to the first bypass flow path and movable between a first position in which fluid flow through the first bypass flow path is restricted and fluid flow to a suction inlet of the compressor is allowed and a second position in which fluid flow through the first bypass flow path is allowed and fluid flow to the suction inlet of the compressor is restricted; a second bypass flow path in selective fluid communication with the first and second reversing valves; and a second bypass valve fluidly connected to the second bypass flow path and movable between a first position in which fluid flow through the second bypass flow path is restricted and fluid flow through the expansion device is allowed and a second position in which fluid flow through the second bypass flow path is allowed and fluid flow through the expansion device is restricted.

In some configurations of the heat-pump system of any one or more of the above paragraphs, the second bypass flow path includes a pump that operates when the second bypass valve is in the second position.

In some configurations, the heat-pump system of any one or more of the above paragraphs includes another indoor heat exchanger, wherein the working-fluid conduit of the supplemental heater is disposed fluidly between the indoor heat exchangers.

In some configurations of the heat-pump system of any one or more of the above paragraphs, the indoor heat exchanger and the supplemental heater are disposed inside of a building when the heat-pump system is fully installed and operational.

In some configurations of the heat-pump system of any one or more of the above paragraphs, the indoor heat exchanger is disposed inside of a building when the heat-pump system is fully installed and operational, and the supplemental heater is disposed outside of the building when the heat-pump system is fully installed and operational.

In some configurations of the heat-pump system of any one or more of the above paragraphs, the fuel burned by the burner is a different substance than the working fluid. In some configurations, the fuel is selected from the group consisting of: natural gas, propane, butane, and kerosene.

In some configurations, the heat-pump system of any one or more of the above paragraphs includes a fuel valve fluidly connected with the burner and configured to control a flow of the fuel to the burner; and a control module configured to control operation of the burner and the fuel valve.

In some configurations of the heat-pump system of any one or more of the above paragraphs, the control module controls operation of the burner and the fuel valve based on a temperature of working fluid flowing between the burner and the indoor heat exchanger.

In some configurations of the heat-pump system of any one or more of the above paragraphs, the control module controls operation of the burner and the fuel valve based on an outdoor ambient air temperature.

In some configurations of the heat-pump system of any one or more of the above paragraphs, the control module controls operation of the burner and the fuel valve based on fluctuations in a cost of electrical energy.

In some configurations of the heat-pump system of any one or more of the above paragraphs, the control module controls operation of the burner and the fuel valve based on any one or more of the following: an outdoor ambient air temperature, fluctuations in a cost of electrical energy, fluctuations in a cost of the fuel, and a temperature of working fluid flowing between the burner and the indoor heat exchanger.

The present disclosure also provides a heat-pump system that may include a compressor, an outdoor heat exchanger, an indoor heat exchanger, an expansion device, a first reversing valve, a second reversing valve, and a supplemental heater. The outdoor heat exchanger may be in fluid communication with the compressor. The indoor heat exchanger may be in fluid communication with the compressor. The expansion device may be in fluid communication with the indoor and outdoor heat exchangers. The first reversing valve may have a first inlet, a second inlet, a first outlet, and a second outlet. The first inlet of the first reversing valve may be fluidly connected with a discharge outlet of the compressor. The second inlet of the first reversing valve may be fluidly connected with an outlet of the expansion device. The first outlet of the first reversing valve may be fluidly connected with an inlet of the outdoor heat exchanger. The second outlet may provide working fluid to the indoor heat exchanger. The second reversing valve may have a first inlet, a second inlet, a first outlet, and a second outlet. The first inlet of the second reversing valve may be fluidly connected with an outlet of the outdoor heat exchanger. The second inlet of the second reversing valve may be fluidly connected with an outlet of the indoor heat exchanger. The first outlet of the second reversing valve may be fluidly connected with an inlet of the expansion device. The second outlet may provide working fluid to a suction inlet of the compressor. The supplemental heater may include a burner and a working-fluid conduit. The burner may be configured to burn a fuel and heat the working-fluid conduit. The indoor heat exchanger may receive working fluid from the working-fluid conduit such that the working fluid flows from an outlet of the working-fluid conduit to an inlet of the indoor heat exchanger without flowing through any one or more of the compressor, the outdoor heat exchanger, and the expansion device.

In some configurations, the heat-pump system of the above paragraph includes a first bypass flow path, a first bypass valve, a second bypass flow path, and a second bypass valve. The first bypass flow path may be in selective fluid communication with the first and second reversing valves. The first bypass valve may be fluidly connected to the first bypass flow path and movable between a first position in which fluid flow through the first bypass flow path is restricted and fluid flow to a suction inlet of the compressor is allowed and a second position in which fluid flow through the first bypass flow path is allowed and fluid flow to the suction inlet of the compressor is restricted. The second bypass flow path may be in selective fluid communication with the first and second reversing valves. The second bypass valve may be fluidly connected to the second bypass flow path and movable between a first position in which fluid flow through the second bypass flow path is restricted and fluid flow through the expansion device is allowed and a second position in which fluid flow through the second bypass flow path is allowed and fluid flow through the expansion device is restricted.

In some configurations of the heat-pump system of any one or more of the above paragraphs, the second bypass flow path includes a pump that operates when the second bypass valve is in the second position.

In some configurations of the heat-pump system of any one or more of the above paragraphs, the first reversing valve is movable between a first position and a second position, and the second reversing valve is movable between a first position and a second position. When the first reversing valve is in its first position: (a) the first inlet of the first reversing valve is fluidly connected with the second outlet of the first reversing valve, and (b) the second inlet of the first reversing valve is fluidly connected with the first outlet of the first reversing valve. When the second reversing valve is in its first position: (a) the first inlet of the second reversing valve is fluidly connected with the second outlet of the second reversing valve, and (b) the second inlet of the second reversing valve is fluidly connected with the first outlet of the second reversing valve. When the first reversing valve is in its second position: (a) the first inlet of the first reversing valve is fluidly connected with the first outlet of the first reversing valve, (b) the second inlet of the first reversing valve is fluidly connected with the second outlet of the first reversing valve. When the second reversing valve is in its second position: (a) the first inlet of the second reversing valve is fluidly connected with the first outlet of the second reversing valve, and (b) the second inlet of the second reversing valve is fluidly connected with the second outlet of the second reversing valve.

In some configurations of the heat-pump system of any one or more of the above paragraphs, the heat-pump system is operable in a first heating mode, a cooling mode, a defrost mode, and a second heating mode. In the first heating mode: (a) the first and second reversing valves are in their first positions, (b) the first and second bypass valves are in their first positions, (c) the pump is shutdown, and (d) the compressor is operating. In the cooling mode: (a) the first and second reversing valves are in their second positions, (b) the first and second bypass valves are in their first positions, (c) the pump is shut down, and (d) the compressor is operating. In the defrost mode: (a) the first and second reversing valves are in their first positions, (b) the first and second bypass valves are in their second positions, (c) the pump is operating, and (d) the compressor is shut down. In the second heating mode: (a) the first reversing valve is in its second position, (b) the second reversing valve is in its first position, (c) the second bypass valve is in its second position, (c) the pump is operating, and (d) the compressor is shut down.

In some configurations, the heat-pump system of any one or more of the above paragraphs include a fuel valve fluidly connected with the burner and configured to control a flow of the fuel to the burner; and a control module configured to control operation of the burner and the fuel valve. The control module selectively operates the burner and opens the fuel valve when the heat-pump system is operating in the first heating mode, the defrost mode, and the second heating mode.

In some configurations of the heat-pump system of any one or more of the above paragraphs, working fluid flows through the indoor heat exchanger in the same direction in the first heating mode, the cooling mode, the defrost mode, and the second heating mode.

In some configurations of the heat-pump system of any one or more of the above paragraphs, working fluid flows through the outdoor heat exchanger in the same direction in the first heating mode, the cooling mode, the defrost mode, and the second heating mode.

In some configurations of the heat-pump system of any one or more of the above paragraphs, working fluid flows through the expansion device in the same direction in the first heating mode, the cooling mode, the defrost mode, and the second heating mode.

In some configurations of the heat-pump system of any one or more of the above paragraphs, working fluid flows through the working-fluid conduit in the same direction in the first heating mode, the cooling mode, the defrost mode, and the second heating mode.

In some configurations of the heat-pump system of any one or more of the above paragraphs, the control module controls operation of the burner and the fuel valve based on a temperature of working fluid flowing between the burner and the indoor heat exchanger.

In some configurations of the heat-pump system of any one or more of the above paragraphs, the control module controls operation of the burner and the fuel valve based on an outdoor ambient air temperature.

In some configurations of the heat-pump system of any one or more of the above paragraphs, the control module controls operation of the burner and the fuel valve based on fluctuations in a cost of electrical energy.

In some configurations of the heat-pump system of any one or more of the above paragraphs, the control module controls operation of the burner and the fuel valve based on any one or more of the following: an outdoor ambient air temperature, fluctuations in a cost of electrical energy, fluctuations in a cost of the fuel, and a temperature of working fluid flowing between the burner and the indoor heat exchanger.

In some configurations, the heat-pump system of any one or more of the above paragraphs includes another indoor heat exchanger. The working-fluid conduit of the supplemental heater may be disposed fluidly between the indoor heat exchangers.

The present disclosure also provides a heat-pump system that includes a compressor, an outdoor heating exchanger, an indoor heat exchanger, an expansion device, and a supplemental heater. The outdoor heat exchanger may be in fluid communication with the compressor. The indoor heat exchanger may be in fluid communication with the compressor. The expansion device may be in fluid communication with the indoor and outdoor heat exchangers. The supplemental heater may include a heat source and a working-fluid conduit. The heat source is in a heat-transfer relationship with the working-fluid conduit such that the heat source is configured to heat the working-fluid conduit. The working-fluid conduit may be disposed fluidly between the expansion device and the indoor heat exchanger.

In some configurations of the heat-pump system of the above paragraph, the heat source could include any one or more of: a burner (configured to burn a fuel), an electric heating element, and a heat exchanger of a waste-heat-recovery system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Corresponding reference numerals indicate corresponding parts throughout the several views of the drawings.

DETAILED DESCRIPTION

Figure 1:
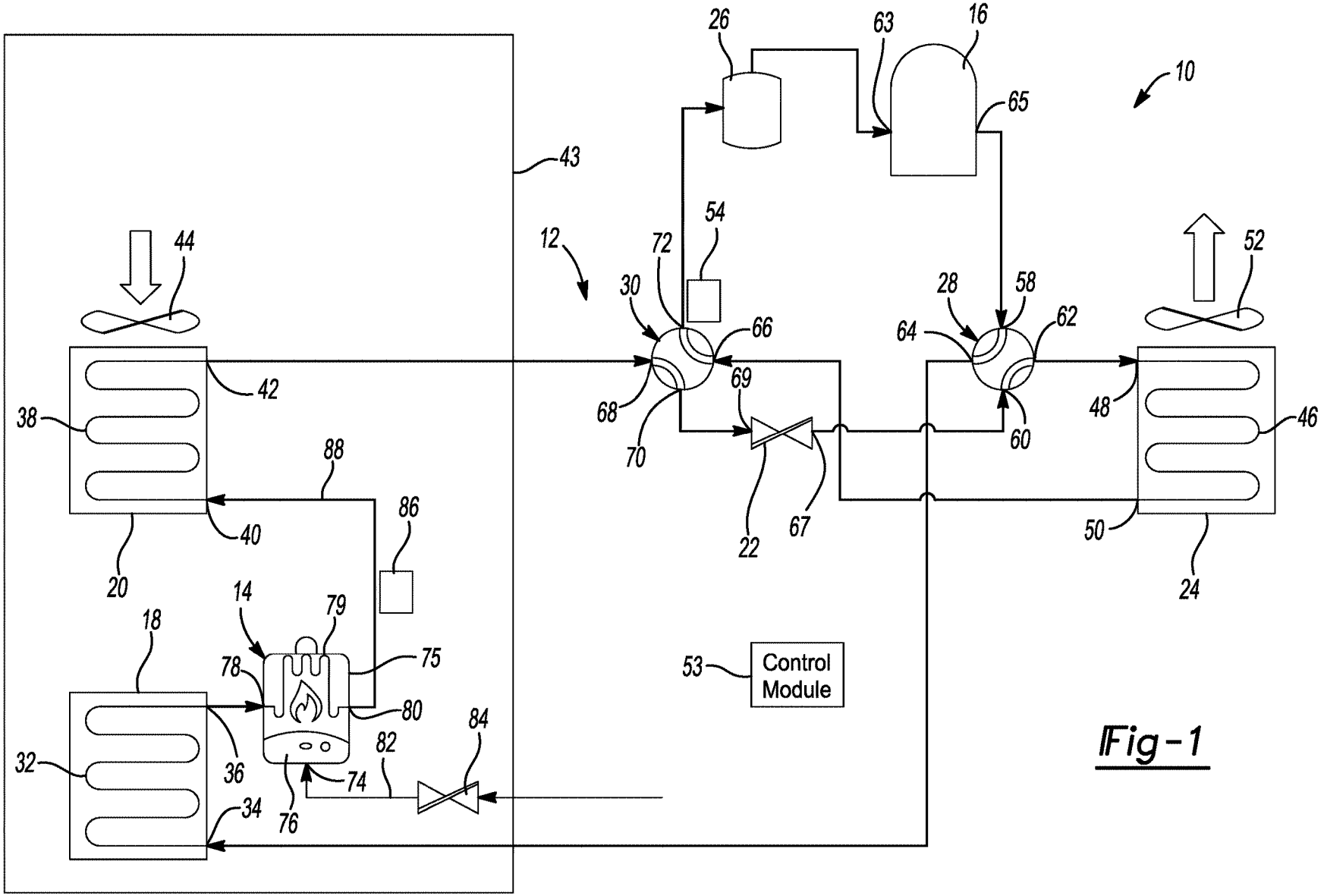
FIG. 1 is a schematic representation of a heat-pump system operating in a heating mode.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
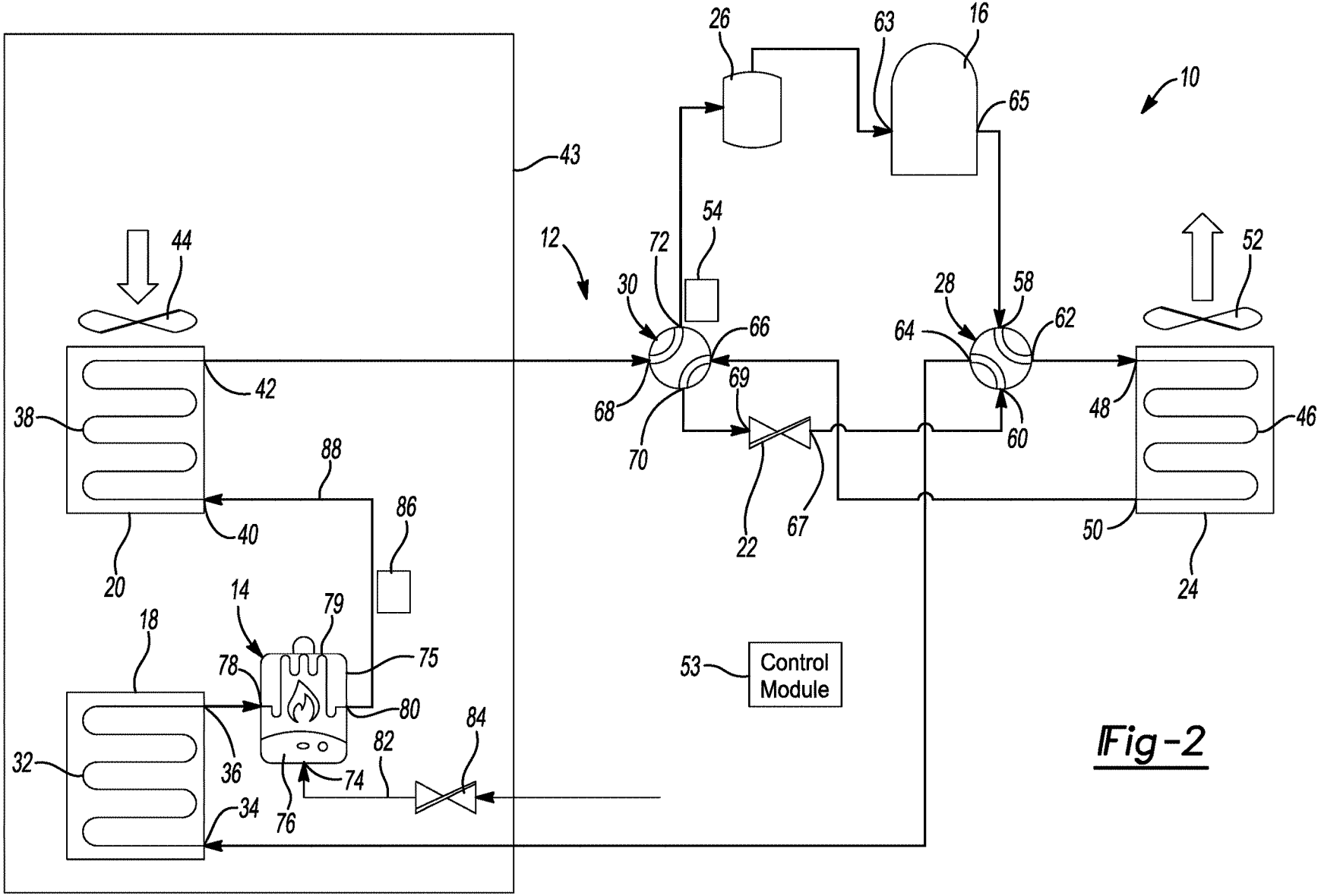
FIG. 2 is a schematic representation of the heat-pump system of FIG. 1 operating in a cooling mode.

With reference to FIGS. 1 and 2, a heat-pump system 10 is provided. The system 10 is operable in a heating mode (FIG. 1) and in a cooling mode (FIG. 2). As will be described in more detail below, the system 10 is a hybrid heat-pump system—i.e., the system 10 includes an electrically powered vapor-compression circuit 12 and a supplemental heater (e.g., a fuel-burning boiler) 14 that can selectively heat working fluid in the vapor-compression circuit 12 to provide supplemental heating capacity for the system 10 in the heating mode. Such supplemental heating capacity may be particularly beneficial in cold-weather climates where traditional heat-pump systems are often incapable of adequately heating a home or building.

The vapor-compression circuit 12 may include a compressor 16, a first indoor heat exchanger 18, a second indoor heat exchanger 20, an expansion device 22 (an expansion valve or a capillary tube), an outdoor heat exchanger 24, an accumulator 26, a first multiway valve (reversing valve) 28, and a second multiway valve (reversing valve) 30.

The compressor 16 may pump working fluid (refrigerant) through the vapor-compression circuit 12 in the heating and cooling modes. The compressor 16 could be a scroll compressor (including first and second scrolls with intermeshing spiral wraps), for example, or any other type of compressor such as reciprocating (including a piston reciprocatingly received in a cylinder) or rotary vane compressor (including a rotor rotating within a cylinder), for example. The compressor 16 could be a variable-capacity compressor operable in full capacity mode and a reduced capacity mode. In some configurations, the compressor 16 could include additional or alternative capacity modulation capabilities (e.g., variable-speed motor, vapor injection, blocked suction, etc.). The compressor 16 may include a suction inlet 63 and a discharge outlet 65. The inlet 63 may receive working fluid from the accumulator 26. The working fluid received through the inlet 63 may be compressed (by a compression mechanism) in the compressor 16 and may be discharged through the outlet 65.

The first indoor heat exchanger 18 may include a coil (or conduit) 32 having an inlet 34 and an outlet 36. Similarly, the second indoor heat exchanger 20 may include a coil (or conduit) 38 having an inlet 40 and an outlet 42. The first and second indoor heat exchangers 18, 20 are disposed inside of a building (or house) 43. A fan 44 may force air across the first and second heat exchangers 18, 20 to facilitate heat transfer between working fluid in the coils 32, 38 and air in the building 43 to heat a space within the building 43 in the heating mode or cool the space within the building 43 in the cooling mode. In some configurations, each indoor heat exchanger 18, 20 could have its own fan. The outdoor heat exchanger 24 may include a coil (or conduit) 46 having an inlet 48 and an outlet 50. A fan 52 may force air across the outdoor heat exchanger 24 to facilitate heat transfer between outdoor ambient air and working fluid flowing through the coil 46.

The first and second valves 28, 30 are movable between a first position (FIG. 1) corresponding to the heating mode of the system 10 and a second position (FIG. 2) corresponding to the cooling mode of the system 10. Movement of the first and second valves 28, 30 between the first and second positions switches the system 10 between the heating and cooling modes. Each of the first and second valves 28, 30 can include a movable valve member (e.g., a slidable body or a rotatable body) that is movable between the first and second positions and can be actuated by a solenoid, stepper motor, or fluid pressure. A control module 53 controls operation of the first and second valves 28, 30 and controls movement between the first and second positions. The control module 53 may also control operation of the expansion device 22 (e.g., based on data from a temperature sensor 54 and/or other operating parameters), the compressor 16, and the fans 44, 52 of the indoor and outdoor heat exchangers 18, 20, 24.

The first valve 28 may include a first inlet 58, a second inlet 60, a first outlet 62, and a second outlet 64. The valve member of the first valve 28 is movable relative to the inlets 58, 60 and outlets 62, 64 between the first and second positions. The first inlet 58 of the first valve 28 is fluidly connected to a discharge outlet 65 of the compressor 16. The second inlet 60 of the first valve 28 is fluidly connected to an outlet 67 of the expansion device 22. The first outlet 62 of the first valve 28 is fluidly connected to the inlet 48 of the outdoor heat exchanger 24. The second outlet 64 of the first valve 28 is fluidly connected to the inlet 34 of the first indoor heat exchanger 18.

The second valve 30 may include a first inlet 66, a second inlet 68, a first outlet 70, and a second outlet 72. The valve member of the second valve 30 is movable relative to the inlets 66, 68 and outlets 70, 72 between the first and second positions. The first inlet 66 of the second valve 30 is fluidly connected to the outlet 50 of the outdoor heat exchanger 24. The second inlet 68 of the second valve 30 is fluidly connected to the outlet 42 of the second indoor heat exchanger 20. The first outlet 70 of the second valve 30 is fluidly connected to an inlet 69 of the expansion device 22. The second outlet 72 of the second valve 30 is fluidly connected to an inlet of the accumulator 26 (or to a suction inlet 63 of the compressor 16).

The supplemental heater 14 may include a housing 75, a burner 76 disposed within the housing 75, and a working-fluid coil (or conduit or vessel) 79 disposed within the housing 75. The working-fluid conduit 79 includes a working-fluid inlet 78 and a working-fluid outlet 80. The burner 76 includes a fuel inlet 74 that is fluidly coupled with a fuel conduit 82. A fuel valve 84 (actuated by a solenoid, a stepper motor, or other actuator) may be disposed along the fuel conduit 82 or at the fuel inlet 74. The fuel valve 84 is movable between open and closed positions to control a flow of fuel from a fuel source (not shown) and the burner 76. The control module 53 may control operation of the fuel valve 84 based on data from a temperature sensor 86 (and/or other operating parameters of the system 10). The temperature sensor 86 may be disposed along a conduit 88 that fluidly connects the working-fluid outlet 80 of the heater 14 to the inlet 40 of the second indoor heat exchanger 20. The temperature sensor 86 measures the temperature of the working fluid flowing through the conduit 88. In some configurations, a pressure sensor could also be disposed along the conduit 88 and data from the pressure sensor could be used to calculate superheat.

The burner 76 may include an ignitor that is configured to ignite fuel received from the fuel source. The fuel may be a flammable gas or liquid such as natural gas, propane, butane, kerosene (paraffin), or heating oil, for example. The fuel source can be a gas utility supplier or a fuel storage tank, for example. In some configurations, the burner 76 could be or include a wood-burning stove or coal-burning stove. In some configurations, the heater 14 could include an electric heating element instead of (or in additional to) the burner 76. In some configurations, the heater 14 could include a heat exchanger of a wastewater-heat-recovery system instead of (or in additional to) the burner 76. In the particular example shown in FIGS. 1 and 2, the supplemental heater 14 may be disposed within the building 43. The fuel valve 84 can be disposed inside or outside of the building 43.

The working-fluid conduit 79 is fluidly connected to and extends between the working-fluid inlet 78 and the working-fluid outlet 80. Working fluid flowing through the working-fluid conduit 79 can be heated by the burner 76 while the burner 76 is operating. The working-fluid conduit 79 may be disposed between the first and second indoor heat exchanges 18, 20. That is, the working-fluid conduit 79 may receive working fluid from the outlet 36 of the first indoor heat exchanger 18, and the inlet 40 of the second indoor heat exchanger 20 may receive working fluid from the working-fluid conduit 79.

With continued reference to FIGS. 1 and 2, operation of the system 10 will be described in detail. When the heat-pump system 10 is in the heating mode (FIG. 1): (a) the first valve 28 allows the first inlet 58 of the first valve 28 to be fluidly connected with the second outlet 64 of the first valve 28, (b) the first valve 28 allows the second inlet 60 of the first valve 28 to be fluidly connected with the first outlet 62 of the first valve 28, (c) the second valve 30 allows the first inlet 66 of the second valve 30 to be fluidly connected with the second outlet 72 of the second valve 30, and (d) the second valve 30 allows the second inlet 68 of the second valve 30 to be fluidly connected with the first outlet 70 of the second valve 30.

Accordingly, when the heat-pump system 10 is in the heating mode, compressed working fluid is discharged from the compressor 16, flows into the first inlet 58 of the first valve 28 and exits the first valve 28 through the second outlet 64. From the second outlet 64, the working fluid flows into the inlet 34 of the first indoor heat exchanger 18, through the indoor heat exchanger 18 (where heat is transferred from the working fluid to the space within the building 43), and exits the first indoor heat exchanger 18 through the outlet 36. From the first indoor heat exchanger 18, the working fluid flows into the working-fluid inlet 78 of the supplemental heater 14, through the working-fluid conduit 79, and out of the heater 14 through the working-fluid outlet 80.

The working fluid flowing through the working-fluid conduit 79 of the heater 14 may be heated by the burner 76. The control module 53 may operate the burner 76 based on an outdoor ambient temperature, data from the sensor 86, a difference between a thermostat setpoint temperature and an actual temperature within the building 43, and/or utility rates (e.g., costs of electricity and/or natural gas), for example. That is, when the system 10 is in the heating mode, the control module 53 can control operation of the burner 76 and the fuel valve 84 to heat the working fluid in the working-fluid conduit 79: (a) when the outdoor ambient temperature is below a predetermined temperature, (b) when the temperature measured by the sensor 86 is below a predetermined temperature, (c) when the difference between the setpoint temperature and the actual indoor temperature is greater than a predetermined threshold, (d) during times of the day when the cost of electricity is relatively high, (e) during times of the day when the cost of natural gas (or other fuel) is relatively low, and/or (f) when the control module 53 determines that the system 10 should operate in a defrost cycle, for example. In some configurations, the control module 53 may include or be in communication with a user interface that allows a user to manually turn the burner 76 on or off.

From the working-fluid outlet 80 of the heater 14, the working fluid flows into the inlet 40 of the second indoor heat exchanger 20, through the second indoor heat exchanger 20 (where heat is transferred from the working fluid to the space within the building 43), and exits the second indoor heat exchanger 20 through the outlet 42. From the outlet 42 of the second indoor heat exchanger 20, the working fluid flows into the second inlet 68 of the second valve 30 and exits the second valve 30 through the first outlet 70. From the first outlet 70, the working fluid flows into the inlet 69 of the expansion device 22. As the working fluid flows through the expansion device 22, the temperature and pressure of the working fluid are lowered. From the outlet 67 of the expansion device 22, the working fluid flows into the second inlet 60 of the first valve 28 and exits the first valve 28 through the first outlet 62. From the first outlet 62, the working fluid flows into the inlet 48 of the outdoor heat exchanger 24, through the outdoor heat exchanger 24 (where the working fluid is in a heat transfer relationship with the ambient outdoor air), and exits the outdoor heat exchanger 24 through the outlet 50. From the outdoor heat exchanger 24, the working fluid flows into first inlet 66 of the second valve 30 and exits the second valve 30 through the second outlet 72. From the second outlet 72, the working fluid flows into the suction inlet 63 of the compressor 16 (or through the accumulator 26 and then into the suction inlet 63 of the compressor 16). The working fluid is then compressed in the compressor 16 and the cycle described above can repeat.

When the heat-pump system 10 is in the cooling mode (FIG. 2): (a) the first valve 28 allows the first inlet 58 of the first valve 28 to be fluidly connected with the first outlet 62 of the first valve 28, (b) the first valve 28 allows the second inlet 60 of the first valve 28 to be fluidly connected with the second outlet 64 of the first valve 28, (c) the second valve 30 allows the first inlet 66 of the second valve 30 to be fluidly connected with the first outlet 70 of the second valve 30, and (d) the second valve 30 allows the second inlet 68 of the second valve 30 to be fluidly connected with the second outlet 72 of the second valve 30.

Accordingly, when the heat-pump system 10 is in the cooling mode, compressed working fluid is discharged from the compressor 16, flows into the first inlet 58 of the first valve 28 and exits the first valve 28 through the first outlet 62. From the first outlet 62, the working fluid flows into the inlet 48 of the outdoor heat exchanger 24, through the outdoor heat exchanger 24 (where heat is transferred from the working fluid to ambient outdoor air), and exits the outdoor heat exchanger 24 through the outlet 50. From the outdoor heat exchanger 24, the working fluid flows into first inlet 66 of the second valve 30 and exits the second valve 30 through the first outlet 70. From the first outlet 70, the working fluid flows into the inlet 69 of the expansion device 22. As the working fluid flows through the expansion device 22, the temperature and pressure of the working fluid are lowered. From the outlet 67 of the expansion device 22, the working fluid flows into the second inlet 60 of the first valve 28 and exits the first valve 28 through the second outlet 64. From the second outlet 64, the working fluid flows into the inlet 34 of the first indoor heat exchanger 18, through the indoor heat exchanger 18 (where heat is transferred to the working fluid from a space within the building 43), and exits the first indoor heat exchanger 18 through the outlet 36. From the first indoor heat exchanger 18, the working fluid flows through the working-fluid conduit 79 of the supplemental heater 14 (the burner 76 of the heater 14 is turned off and the fuel valve 84 is closed when the system 10 is in the cooling mode). From the heater 14, the working fluid flows into second inlet 68 of the second valve 30 and exits the second valve 30 through the second outlet 72. From the second outlet 72, the working fluid flows into the suction inlet 63 of the compressor 16 (or through the accumulator 26 and then into the suction inlet 63 of the compressor 16). The working fluid is then compressed in the compressor 16 and the cycle described above can repeat.

As described above, the direction of fluid flow through the outdoor heat exchanger 24 is the same in the cooling mode and in the heating mode. That is, as shown in FIGS. 1 and 2, fluid flows into the outdoor heat exchanger 24 through the inlet 48 and exits the outdoor heat exchanger 24 through the outlet 50. Stated yet another way, the opening of the outdoor heat exchanger 24 designated as the "inlet" of the outdoor heat exchanger 24 is the same opening in the heating and cooling modes, and the opening of the outdoor heat exchanger 24 designated as the "outlet" of the outdoor heat exchanger 24 is the same opening in the heating and cooling modes. The same is true for the first and second indoor heat exchangers 18, 20—i.e., the direction of fluid flow through the first and second indoor heat exchangers 18, 20 is the same in the cooling mode and in the heating mode. That is, the openings of the first and second indoor heat exchangers 18, 20 designated as the "inlets" of first and second indoor heat exchangers 18, 20 are the same openings in the heating and cooling modes, and the openings of the first and second indoor heat exchangers 18, 20 designated as the "outlets" of the first and second indoor heat exchangers 18, 20 are the same opening in the heating and cooling modes. Furthermore, as shown in FIGS. 1 and 2, the direction of fluid flow through the expansion device 22 and heater 14 is the same in the cooling mode and in the heating mode.

Having the fluid flow through the heat exchangers 24, 18, 20 in the same directions in both the heating and cooling modes allows for optimized heat transfer in both modes. Having the direction of working fluid flow be counter (or opposite) the direction of the flow of air forced across the heat exchangers 24, 18, 20 by their respective fans improves heat transfer. By having the working fluid flow in the same direction through the heat exchangers 24, 18, 20 in the heating and cooling modes, the direction of working fluid flow can be counter to the direction of airflow in both modes. This improved heat transfer between the air and working fluid improves the efficiency of the heat-pump system 10. Furthermore, because the working fluid flows through the heat exchangers 18, 20, 24 and expansion device 22 in the same direction in the heating and cooling modes, the system 10 can operate with only a single expansion device 16 (as opposed to prior-art heat-pump systems that have two expansion devices).

Figure 3:
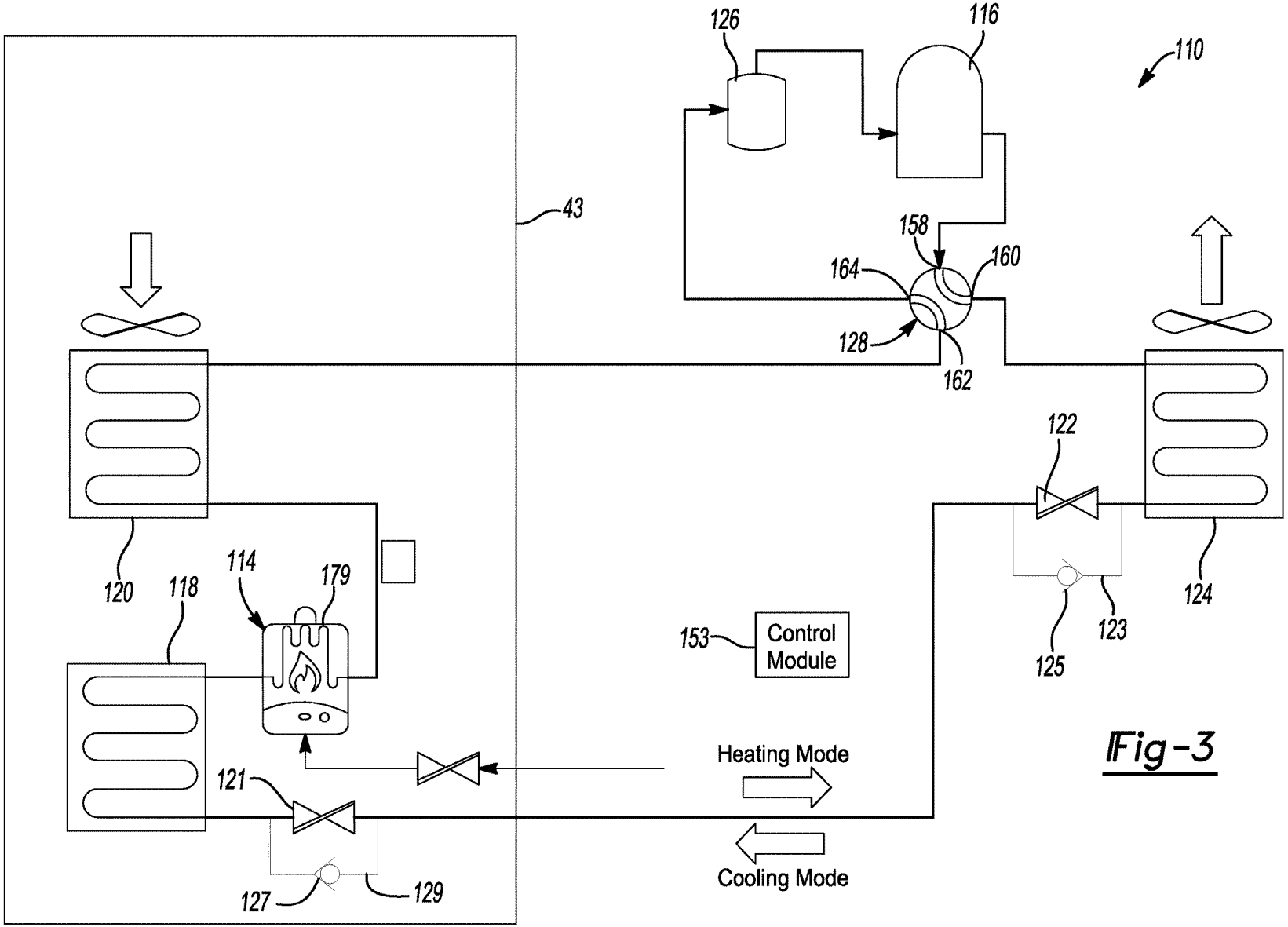
FIG. 3 is a schematic representation of another heat-pump system.

Referring now to FIG. 3, another heat-pump system 110 is provided. The system 110 may include supplemental heater 114, a compressor 116, a first indoor heat exchanger 118, a second indoor heat exchanger 120, a first expansion device 121, a second expansion device 122, an outdoor heat exchanger 124, an accumulator 126, a multiway valve (reversing valve) 128, and a control module 153. The structure and function of the supplemental heater 114, compressor 116, first indoor heat exchanger 118, second indoor heat exchanger 120, expansion devices 121, 122, outdoor heat exchanger 124, accumulator 126, and control module 153 may be similar or identical to that of the supplemental heater 14, compressor 16, first indoor heat exchanger 18, second indoor heat exchanger 20, expansion device 22, outdoor heat exchanger 24, accumulator 26, and control module 53 described above.

The difference between the system 10 and the system 110 is that the system 110 has a single reversing valve 128 as opposed to the two valves 28, 30 of the system 10. The valve 128 of the system 110 includes a first opening 158, a second opening 160, a third opening 162, and a fourth opening 164. The first opening 158 is an inlet that receives working fluid from the compressor 116 in the cooling mode and in the heating mode. The second opening 160 may be fluidly connected to the outdoor heat exchanger 124 such that the second opening 160 provides working fluid to the outdoor heat exchanger 124 in the cooling mode and receives working fluid from the outdoor heat exchanger 124 in the heating mode. The third opening 162 is fluidly connected to the second indoor heat exchanger 120 such that the third opening 162 provides working fluid to the second indoor heat exchanger 120 in the heating mode and receives working fluid from the second indoor heat exchanger 120 in the cooling mode. The fourth opening 164 is an outlet that provides working fluid to the compressor 116 (or to the accumulator 126) in the cooling mode and in the heating mode. In the cooling mode, the first and second openings 158, 160 are fluidly connected with each other, and the third and fourth openings 162, 164 are fluidly connected with each other. In the heating mode, the first and third openings 158, 162 are fluidly connected with each other, and the second and fourth openings 160, 164 are fluidly connected with each other.

In the cooling mode, working fluid flows from the compressor 116, into the first opening 158 of the valve 128, through the second opening 160 and into the outdoor heat exchanger 124. From the outdoor heat exchanger 124, the working fluid flows through a first bypass conduit 123 (i.e., through a first check valve 125 disposed along the first bypass conduit 123) around the second expansion device 122 (which may be closed during the cooling mode). From the first bypass conduit 123, the working fluid flows through the first expansion device 121. A second check valve 127 prevents fluid from flowing through a second bypass conduit 129 in the cooling mode. From the first expansion device 121, the working fluid flows through the first indoor heat exchanger 118, through a working-fluid conduit 179 of the heater 114, and through the second indoor heat exchanger 120. From the second indoor heat exchanger 120, the working fluid flows into the third opening 162, through the fourth opening 164, and back to the compressor 116 (or to the accumulator 126).

In the heating mode, working fluid flows from the compressor 116, into the first opening 158 of the valve 128, through the third opening 162 and into the second indoor heat exchanger 120. The working fluid flows through the second indoor heat exchanger 120, then through the working-fluid conduit 179 of the heater 114, and then through the first indoor heat exchanger 118. From the first indoor heat exchanger 118, the working fluid flows through the second bypass conduit 129 (i.e., through the second check valve 127 disposed along the second bypass conduit 129) around the first expansion device 121 (which may be closed during the cooling mode). From the second bypass conduit 129, the working fluid flows through the second expansion device 122. The first check valve 125 prevents fluid from flowing through a first bypass conduit 123 in the heating mode. From the second expansion device 122, the working fluid flows through the outdoor heat exchanger 124, and into the second opening 160. From the second opening 160, the working fluid flows through the fourth opening 164 and back to the compressor 116 (or to the accumulator 126).

Unlike the system 10, the direction of fluid flow through the heat exchangers 118, 120, 124, the working-fluid conduit 179, and the expansion device 122 are different in the heating and cooling modes.

Figure 4:
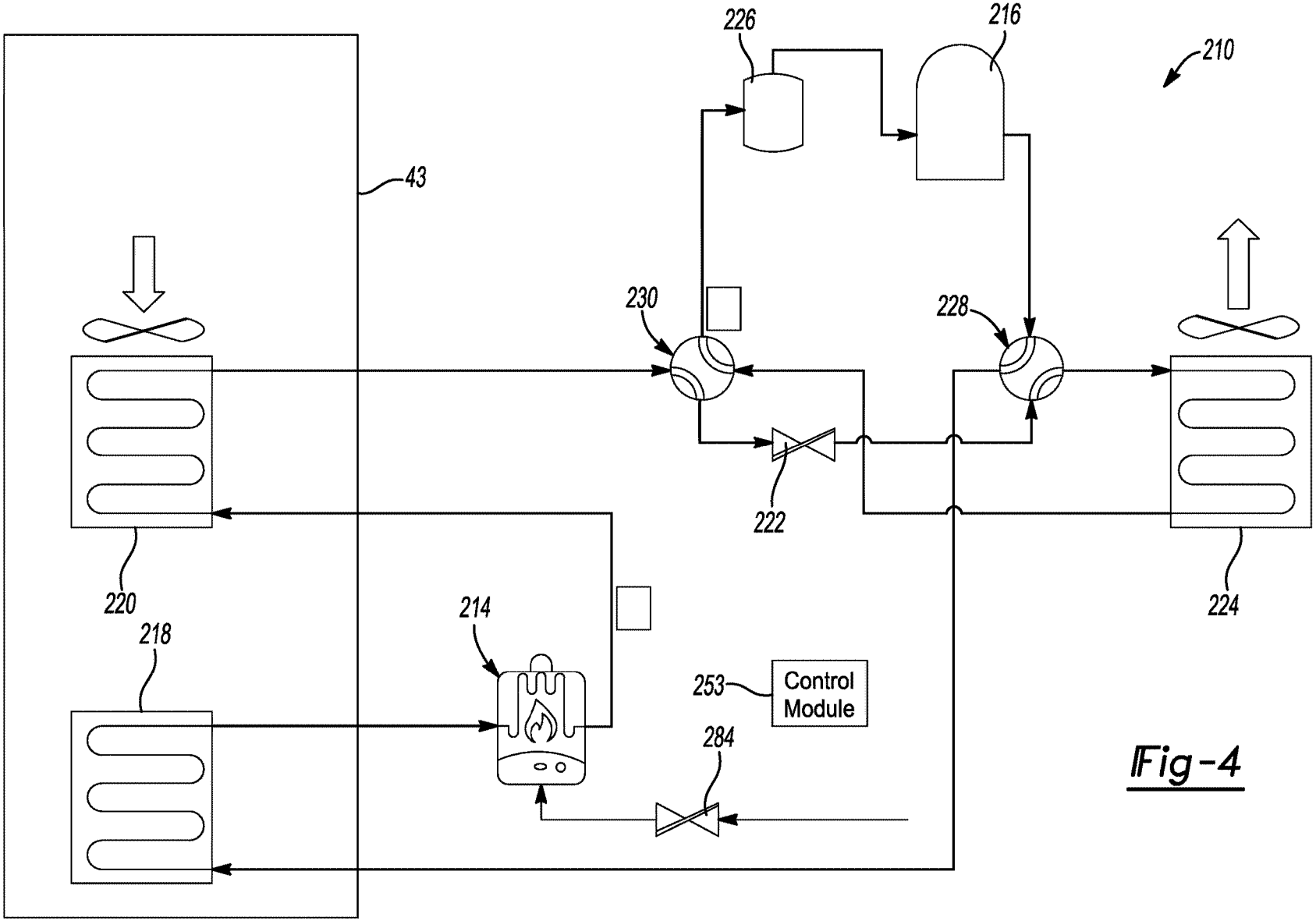
FIG. 4 is a schematic representation of yet another heat-pump system.

Referring now to FIG. 4, another heat-pump system 210 is provided. The system 210 may include supplemental heater 214, a compressor 216, a first indoor heat exchanger 218, a second indoor heat exchanger 220, an expansion device 222, an outdoor heat exchanger 224, an accumulator 226, a first multiway valve (reversing valve) 228, a second multiway valve 230 (reversing valve), and a control module 253. The structure and function of the supplemental heater 214, compressor 216, first indoor heat exchanger 218, second indoor heat exchanger 220, expansion device 222, outdoor heat exchanger 224, accumulator 226, valves 228, 230, and control module 253 may be similar or identical to that of the supplemental heater 14, compressor 16, first indoor heat exchanger 18, second indoor heat exchanger 20, expansion device 22, outdoor heat exchanger 24, accumulator 26, valves 28, 30, and control module 53 described above. The difference between the system 210 and the system 10 is that the supplemental heater 214 and fuel valve 284 of the system 210 are disposed outside of the building 43.

Figure 5:
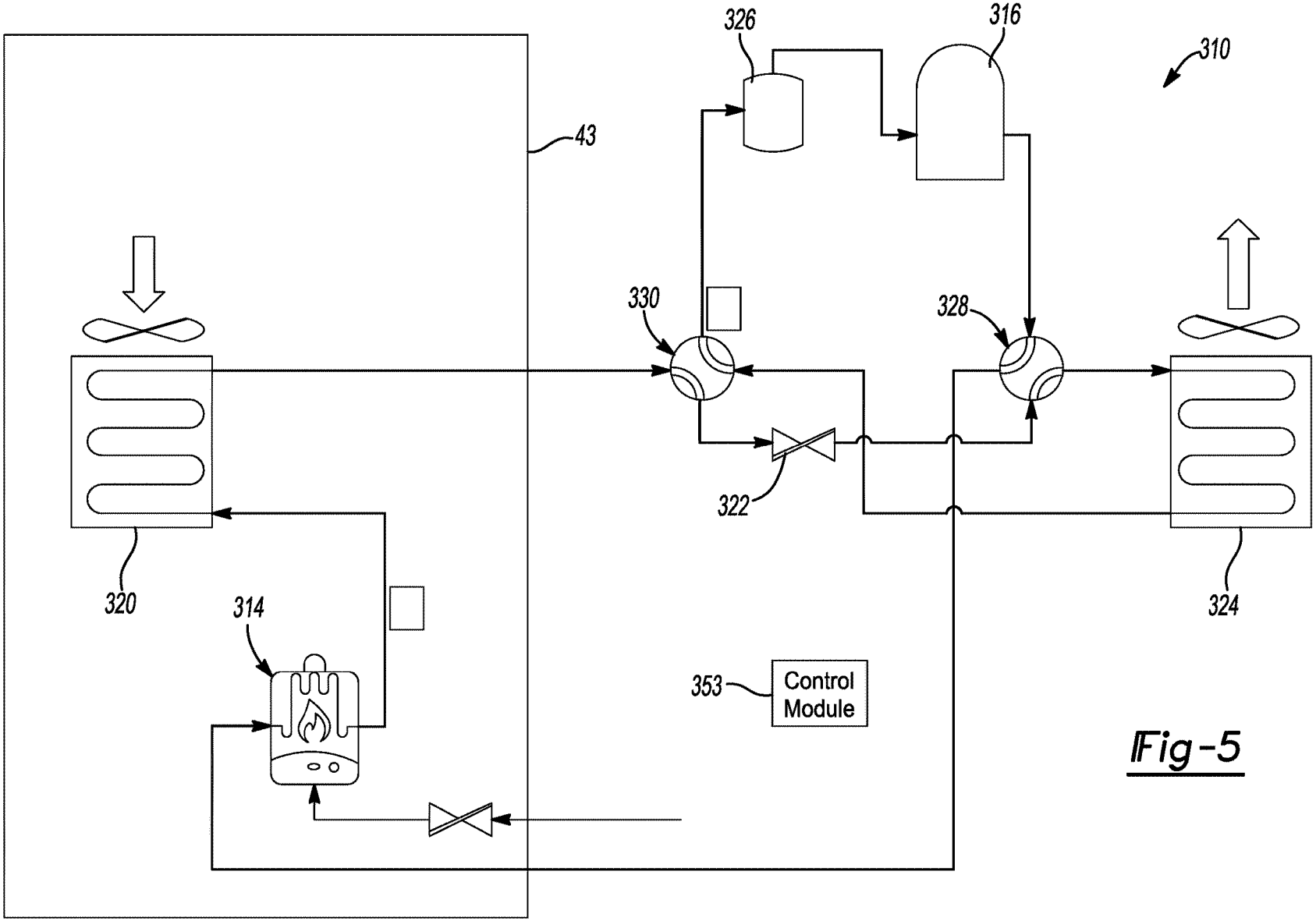
FIG. 5 is a schematic representation of yet another heat-pump system.

Referring now to FIG. 5, another heat-pump system 310 is provided. The system 310 may include supplemental heater 314, a compressor 316, an indoor heat exchanger 320, an expansion device 322, an outdoor heat exchanger 324, an accumulator 326, a first multiway valve (reversing valve) 328, a second multiway valve (reversing valve) 330, and a control module 353. The structure and function of the supplemental heater 314, compressor 316, indoor heat exchanger 320, expansion device 322, outdoor heat exchanger 324, accumulator 326, valves 328, 330, and control module 353 may be similar or identical to that of the supplemental heater 14, compressor 16, second indoor heat exchanger 20, expansion device 22, outdoor heat exchanger 24, accumulator 26, valves 28, 30, and control module 53 described above.

The difference between the system 310 and the system 10 is that the system 310 includes the single indoor heat exchanger 320, rather than first and second indoor heat exchangers. Therefore, in the system 310, working fluid flows from the second outlet 364 of the first valve 328 to the supplemental heater 314, rather than flowing through a first indoor heat exchanger prior to flowing through the supplemental heater 314.

Figure 6:
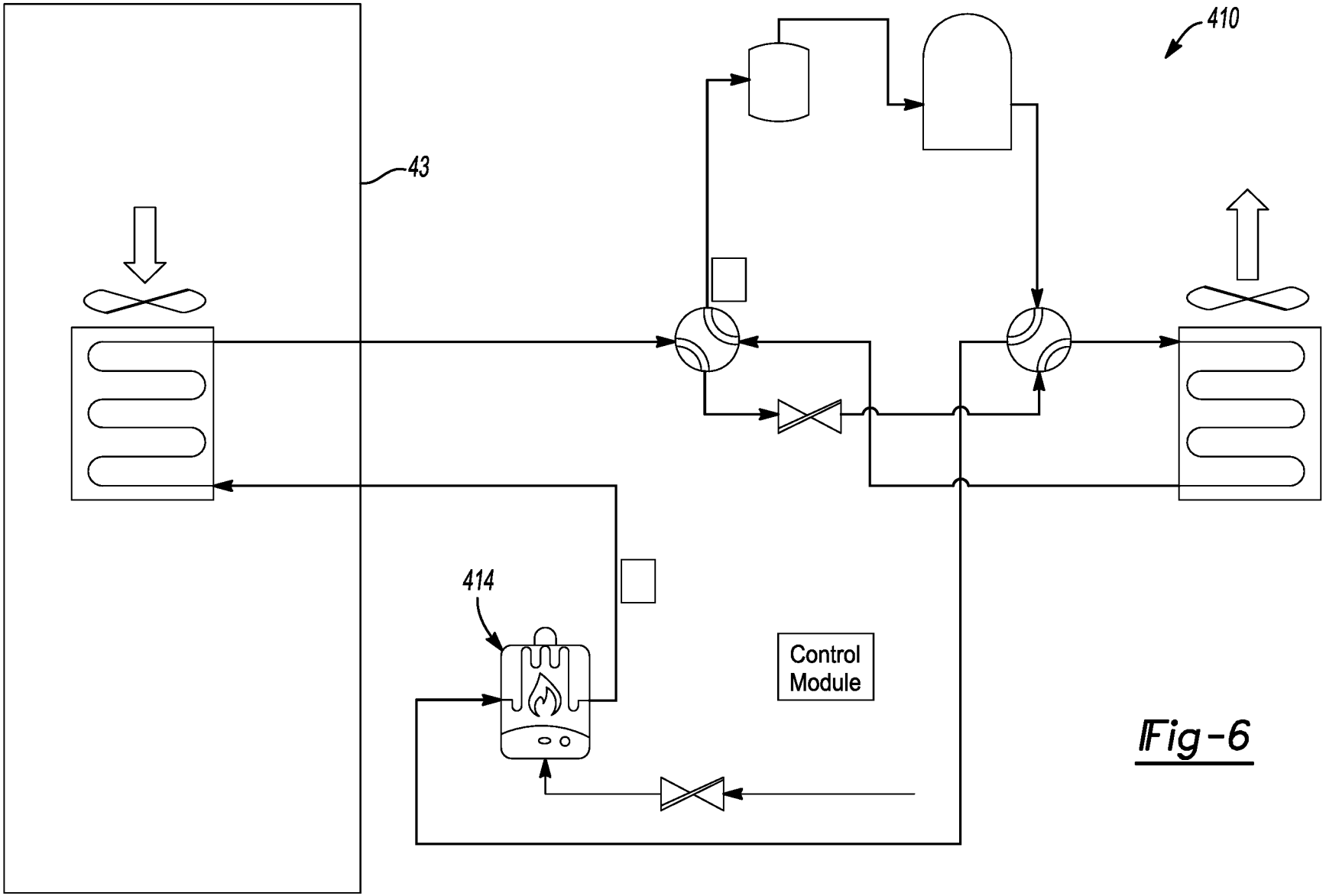
FIG. 6 is a schematic representation of yet another heat-pump system.
Figure 7:
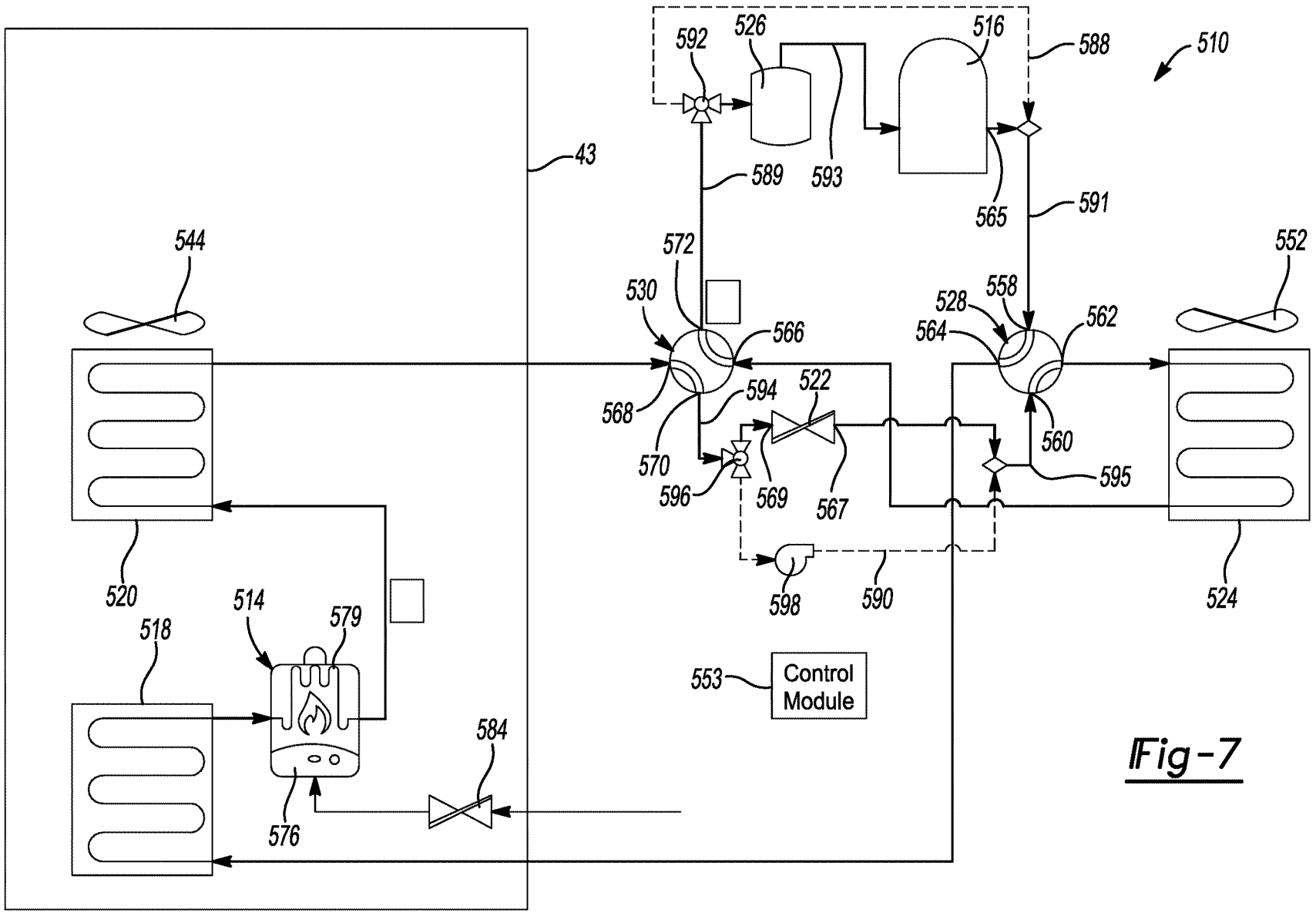
FIG. 7 is a schematic representation of yet another heat-pump system operating in a first heating mode.
Figure 8:
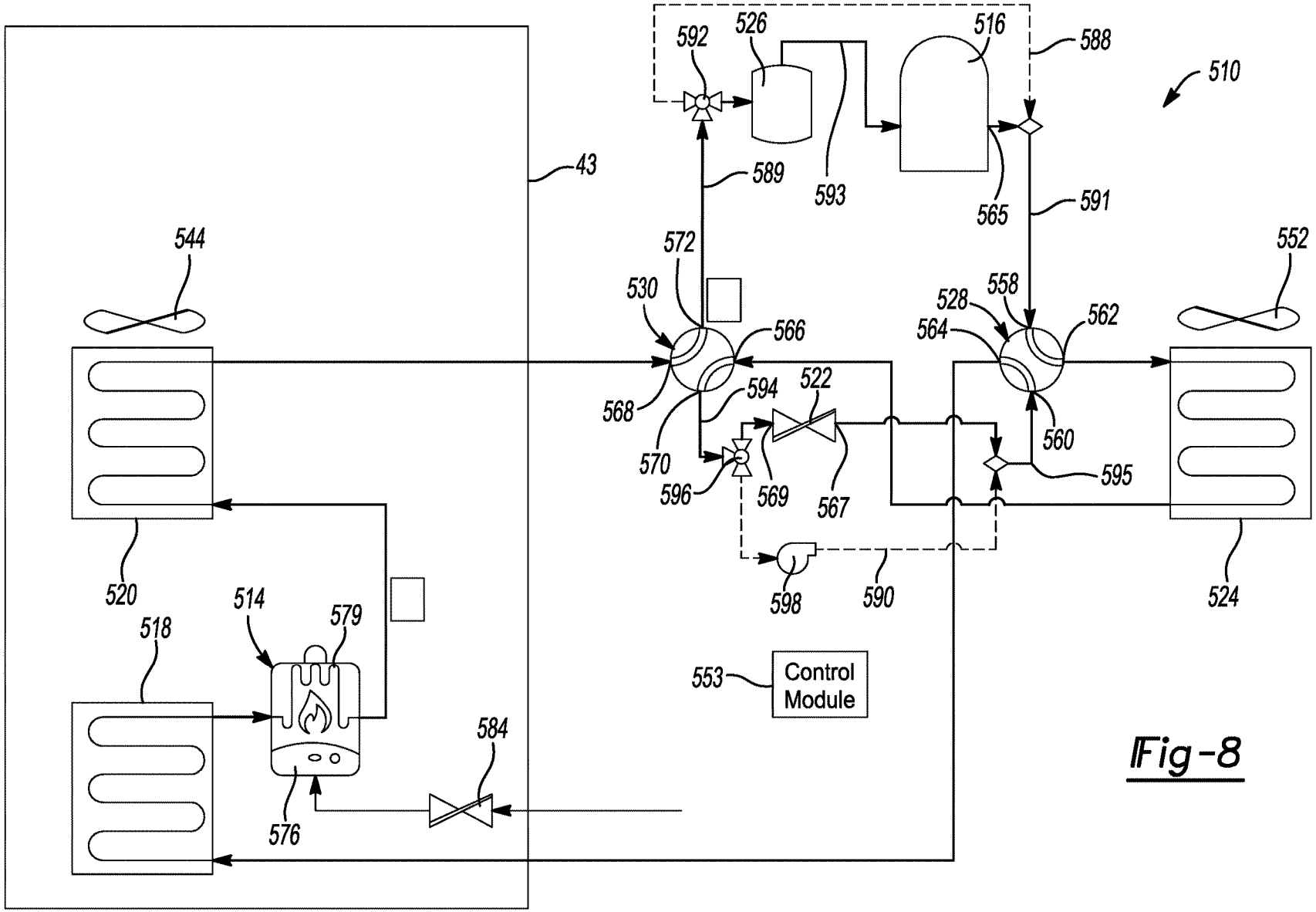
FIG. 8 is a schematic representation of the heat-pump system of FIG. 7 operating in a cooling mode.
Figure 9:
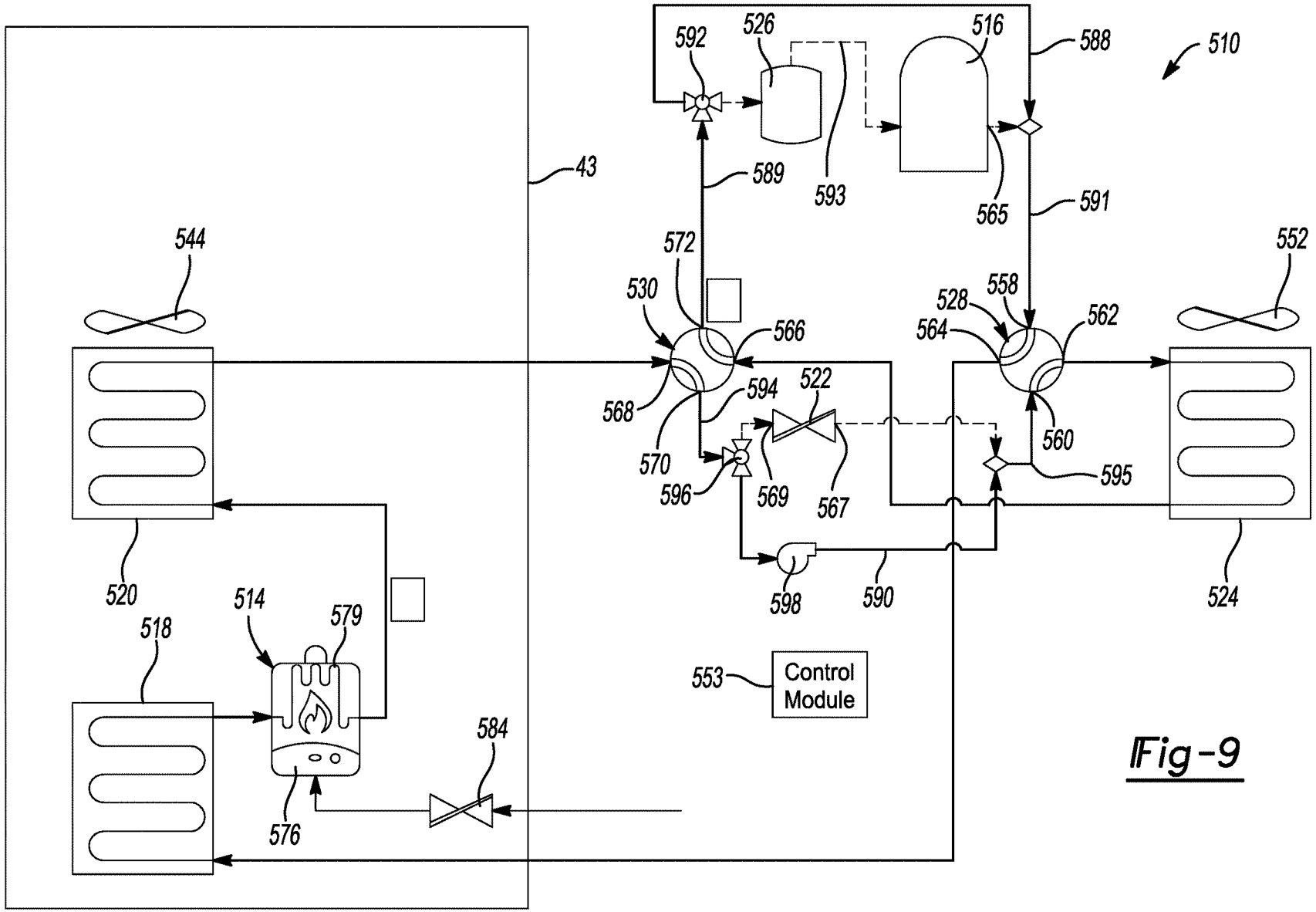
FIG. 9 is a schematic representation of the heat-pump system of FIG. 7 operating in a defrost mode.

Referring now to FIG. 6, another heat-pump system 410 is provided that may be identical to the system 310 in structure and function, except a supplemental heater 414 of the system 410 is disposed outside of the building 43.

Referring now to FIGS. 7-10, another heat-pump system 510 is provided. The system 510 may include supplemental heater 514, a compressor 516, a first indoor heat exchanger 518, a second indoor heat exchanger 520, an expansion device 522, an outdoor heat exchanger 524, an accumulator 526, a first multiway valve (reversing valve) 528, a second multiway valve (reversing valve) 530, and a control module 553. The structure and function of the supplemental heater 514, compressor 516, first indoor heat exchanger 518, second indoor heat exchanger 520, expansion device 522, outdoor heat exchanger 524, accumulator 526, valves 528, 530, and control module 553 may be similar or identical to that of the supplemental heater 14, compressor 16, first indoor heat exchanger 18, second indoor heat exchanger 20, expansion device 22, outdoor heat exchanger 24, accumulator 26, valves 28, 30, and control module 53 described above.

Like the first valve 28, the first valve 528 includes a first inlet 558, a second inlet 560, a first outlet 562, and a second outlet 564. Similarly, the second valve 530 includes a first inlet 566, a second inlet 568, a first outlet 570, and a second outlet 572. Like the valves 28, 30, the valves 528, 530 are movable between a first position and a second position. When the first valve 528 is in the first position (FIGS. 7 and 9), the first inlet 558 is fluidly connected with the second outlet 564, and the second inlet 560 is fluidly connected with the first outlet 562. When the first valve 528 is in the second position (FIGS. 8 and 10), the first inlet 558 is fluidly connected with the first outlet 562, and the second inlet 560 is fluidly connected with the second outlet 564. When the second valve 530 is in the first position (FIGS. 7, 9, and 10), the first inlet 566 is fluidly connected with the second outlet 572, and the second inlet 568 is fluidly connected with the first outlet 570. When the second valve 530 is in the second position (FIG. 8), the first inlet 566 is fluidly connected with the first outlet 570, and the second inlet 568 is fluidly connected with the second outlet 572.

The system 510 may include a first bypass flow path 588 and a second bypass flow path 590. The first bypass flow path 588 extends from a first conduit 589 to a second conduit 591. The first conduit 589 is fluidly connected to the second outlet 572 of the second valve 530 and receives working fluid from the second outlet 572. A first bypass valve 592 (having an inlet and two outlets) is fluidly connected to the first conduit 589, the first bypass flow path 588, and a suction line 593 of the compressor 516 (or to the accumulator 526 disposed along the suction line 593). The first bypass valve 592 is a three-way valve (e.g., a solenoid-actuated three-way valve) that is movable between a first position that allows fluid flow from the first conduit 589 to the suction line 593 and restricts fluid flow through the first bypass flow path 588 and a second position that allows fluid flow from the first conduit 589 to the first bypass flow path 588 and restricts fluid flow through the suction line 593.

The second conduit 591 is fluidly connected to the first inlet 558 of the first valve 528 and a discharge outlet 565 of the compressor 516 such that working fluid discharged from the compressor 516 flows through the second conduit 591 to the first inlet 558 of the first valve 528.

When the first bypass valve 592 is in the first position (FIGS. 7 and 8), working fluid flows from the second outlet 572 of the second valve 530, through the first bypass valve 592 and into the accumulator 526 or suction line 593, and fluid flow through the first bypass flow path 588 is restricted or prevented. When the first bypass valve 592 is in the second position (FIG. 9), fluid flow to the accumulator 526, suction line 593, and compressor 516 is restricted or prevented. Instead, when the first bypass valve 592 is in the second position, working fluid flows from the second outlet 572 of the second valve 530, through the first bypass valve 592, through the first bypass flow path 588, through the second conduit 591, and into the first inlet 558 of the first valve 528. In other words, when the first bypass valve 592 is in the second position, working fluid bypasses the compressor 516.

The second bypass flow path 590 extends from a third conduit 594 to a fourth conduit 595. The third conduit 594 is fluidly connected to the first outlet 570 of the second valve 530 and receives working fluid from the first outlet 570. A second bypass valve 596 (having an inlet and two outlets) is fluidly connected to the third conduit 594, the second bypass flow path 590, and an inlet 569 of the expansion device 522. The second bypass valve 596 is a three-way valve (e.g., a solenoid-actuated three-way valve) that is movable between a first position that allows fluid flow from the third conduit 594 to the inlet 569 of the expansion device 522 and restricts fluid flow through the second bypass flow path 590 and a second position that allows fluid flow from the third conduit 594 to the second bypass flow path 590 and restricts fluid flow through the expansion device 522.

The fourth conduit 595 is fluidly connected to the second inlet 560 of the first valve 528 and an outlet 567 of the expansion device 522 such that working fluid exiting the expansion device 522 flows through the fourth conduit 595 to the second inlet 560 of the first valve 528.

When the second bypass valve 596 is in the first position (FIGS. 7 and 8), working fluid flows from the first outlet 570 of the second valve 530, through the second bypass valve 596 and through the expansion device 522, and fluid flow through the second bypass flow path 590 is restricted or prevented. When the second bypass valve 596 is in the second position (FIGS. 9 and 10), fluid flow through the expansion device 522 is restricted or prevented. Instead, when the second bypass valve 596 is in the second position, working fluid flows from the first outlet 570 of the second valve 530, through the second bypass valve 596, through the second bypass flow path 590, through the fourth conduit 595, and into the second inlet 560 of the first valve 528. In other words, when the second bypass valve 596 is in the second position, working fluid bypasses the expansion device 522.

The second bypass flow path 590 may include a pump 598 disposed downstream of the second bypass valve 596 and upstream of the fourth conduit 595. The pump 598 operates when the second bypass valve 596 is in the second position to pump working fluid through the second bypass flow path 590 (i.e., from the first outlet 570 of the second valve 530 to the second inlet 560 of the first valve 528). The pump 598 may be shut down when the second bypass valve 596 is in the first position.

The control module 553 is in communication with and controls operation of the compressor 516, fans 544, 552 of the heat exchangers 520, 524, the burner 576 of the supplemental heater 514, fuel valve 584, the first and second valves 528, 530, the expansion device 522, the bypass valves 592, 596, and the pump 598.

Figure 10:
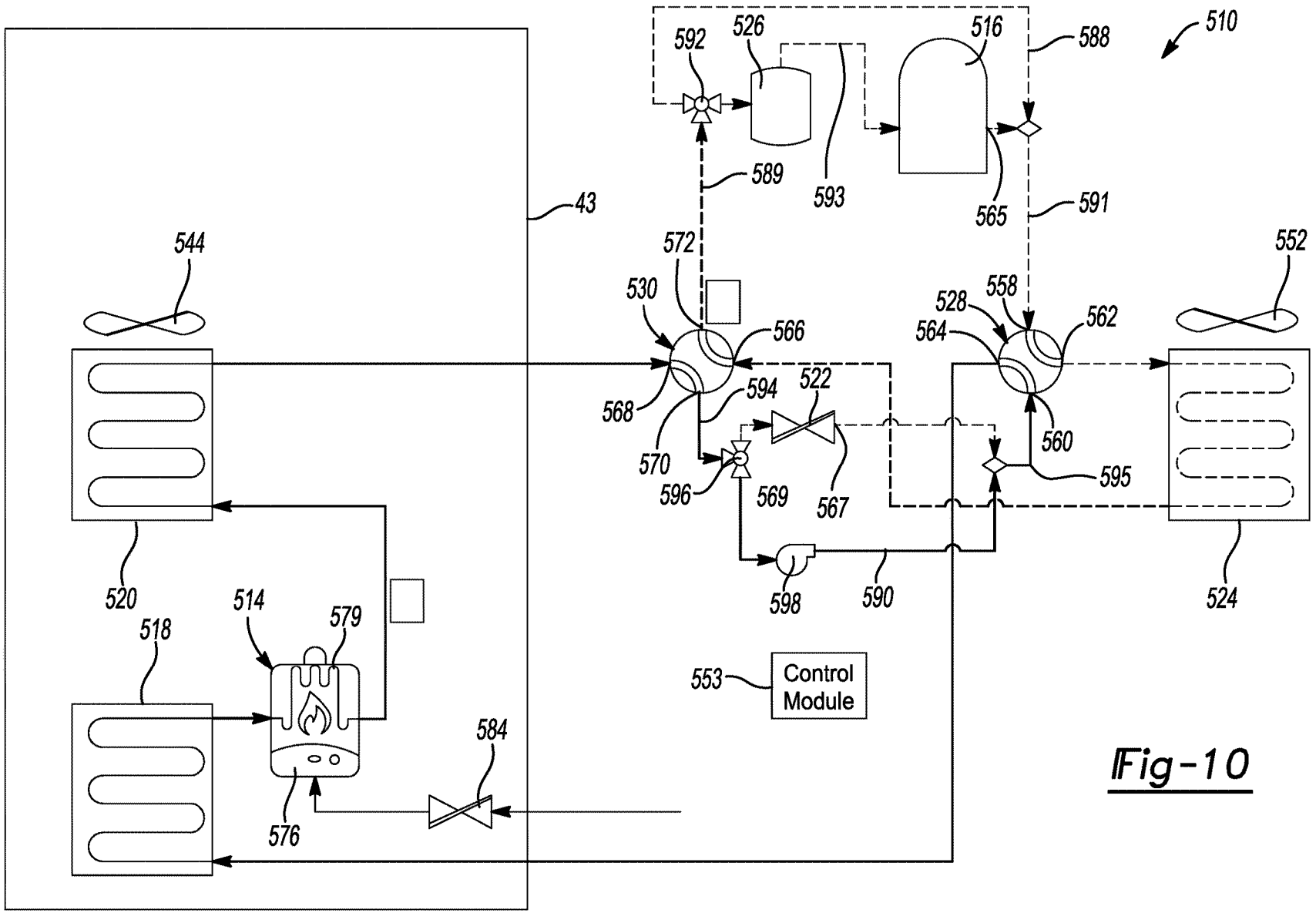
FIG. 10 is a schematic representation of the heat-pump system of FIG. 7 operating in a second heating mode.

The system 510 is operable in a first heating mode (FIG. 7), a cooling mode (FIG. 8), a defrost or free-cooling mode (FIG. 9), and a second heating mode (a non-compressor heating mode) (FIG. 10). In the first heating mode (FIG. 7), the control module 553 may operate the compressor 516, move the bypass valves 592, 596 to their first positions (to restrict or prevent fluid flow through the first and second bypass flow paths 588, 590), and move the first and second valves 528, 530 to their first positions. Accordingly, in the first heating mode, the system 510 operates in the same manner as the system 10 operates in the heating mode, as described above.

In the cooling mode (FIG. 8), the control module 553 may operate the compressor 516, move the bypass valves 592, 596 to their first positions (to restrict or prevent fluid flow through the first and second bypass flow paths 588, 590), and move the first and second valves 528, 530 to their second positions. Accordingly, in the cooling mode, the system 510 operates in the same manner as the system 10 operates in the cooling mode, as described above.

In the defrost mode (FIG. 9), the control module 553 may shut down the compressor 516, move the bypass valves 592, 596 to their second positions (to allow fluid flow through the first and second bypass flow paths 588, 590 to bypass the compressor 516 and expansion device 522), operate the pump 598, and move the first and second valves 528, 530 to their first positions.

Since the compressor 516 is shut down in the defrost mode, the pump 598 circulates the working fluid throughout the system 510. That is, working fluid discharged from the pump 598 flows through the second bypass flow path 590 (bypassing the expansion device 522), through the second inlet 560 of the first valve 528, through the first outlet 562 of the first valve 528, and into the outdoor heat exchanger 524. From the outdoor heat exchanger 524, the working fluid flows through the first inlet 566 of the second valve 530, through the second outlet 572 of the second valve 530, and into the first conduit 589. From the first conduit 589, the working fluid flows through the first bypass valve 592, through the first bypass flow path 588 (bypassing the compressor 516), and into the second conduit 591. From the second conduit 591, the working fluid flows through the first inlet 558 of the first valve 528, through the second outlet 564 of the first valve 528, and into the first indoor heat exchanger 518. From the first indoor heat exchanger 518, the working fluid flows through the working-fluid conduit 579 of the supplemental heater 514, and through the second indoor heat exchanger 520. From the second indoor heat exchanger 520, the working fluid flows through the second inlet 568 of the second valve 530, through the first outlet 570 of the second valve 530, through the second bypass valve 596, and back into the second bypass flow path 590.

When the system 510 is operating in the defrost mode for the purpose of defrosting the outdoor heat exchanger 524 (e.g., when the control module 533 determines that there is or could be frost built up on the outdoor heat exchanger 524), the control module 533 can continuously or intermittently operate the burner 576 of the supplemental heater 514 and open the fuel valve 584 to heat the working fluid flowing through the working-fluid conduit 579 of the heater 514. Working fluid heated by the heater 514 will still be relatively warm when it flows through the outdoor heat exchanger 524, which speeds up defrosting of the outdoor heat exchanger 524. Since the compressor 516 is shut down during the defrost mode, electrical energy consumption of the system 510 is relatively low.

The system 510 can also be operated in the defrost mode for the purpose of cooling the interior of the building 43 (i.e., when air inside of the building 43 is warmer than outdoor ambient air) in a manner that consumes less electrical energy than the cooling mode described above and shown in FIG. 8. When the system 510 is operating in the defrost mode for the purpose of low-energy-consumption cooling, the system can operate as described above with respect to defrosting the outdoor heat exchanger 524, except the control module 533 will not operate the burner 576 of the heater 514 and will close the fuel valve 584. In this manner, relatively cool outdoor air will cool the working fluid in the outdoor heat exchanger 524 so that the working fluid in the indoor heat exchangers 518, 520 can absorb heat from air inside of the building 43.

In the second heating mode (FIG. 10), the control module 553 may shut down the compressor 516, move the second bypass valve 596 to its second positions (to allow fluid flow through the second bypass flow path 590 to bypass the expansion device 522), operate the pump 598, move the first valve 528 to its second position, and move the second valve 530 to its first position.

Positioning the first valve 528 in its second position and positioning the second valve 530 in its first position (as shown in FIG. 10) divides the system 510 into two fluidly separate working fluid loops. One of the loops includes the outdoor heat exchanger 524 and the compressor 516, and the other loop includes the second bypass flow path 590, the indoor heat exchangers 518, 520, and the supplemental heater 514. Since the compressor 516 is shut down in the second heating mode, the working fluid in the loop with the compressor 516 and outdoor heat exchanger 524 may remain stagnant.

Operation of the pump 598 in the second heating mode circulates working fluid through the indoor heat exchangers 518, 520 and the heater 514. That is, in the second heating mode, working fluid discharged from the pump 598 flows through the second bypass flow path 590 (bypassing the expansion device 522), through the fourth conduit 595, through the second inlet 560 of the first valve 528, and through the second outlet 564 of the first valve 528. From the second outlet 564, the working fluid flows through the first indoor heat exchanger 518 and through the working-fluid conduit 579 of the heater 514. While the system 510 is operating in the second heating mode, the control module 533 may continuously or intermittently operate the burner 576 of the heater 514 and open the fuel valve 584 to allow the heater 514 to heat the working fluid in the working-fluid conduit 579. From the working-fluid conduit 579, the heated working fluid flows through the second indoor heat exchanger 520 where heat from the working fluid is transferred to air inside of the building 43. From the second indoor heat exchanger 520, the working fluid flows through the second inlet 568 of the second valve 530, through the first outlet 570 of the second valve 530, through the second bypass valve 596, and back into the second bypass flow path 590.

Since the compressor 516 is shut down during the second heating mode, the system 510 consumes much less electrical energy than it does during operation in the first heating mode. Therefore, it may be particularly advantageous to operate the system 510 in the second heating mode during times of relatively high electrical energy costs.

It will be appreciated that the position of the first bypass valve 592 is irrelevant when the system 510 is operating in the second heating mode since the first bypass valve 592 and first bypass flow path 588 (along with the compressor 516 and outdoor heat exchanger 524) are isolated from the loop in which working fluid circulates (i.e., the loop including the indoor heat exchangers 518, 520, the heater 514, and the second bypass flow path 590). It is also noted that when the system 510 is operating in the defrost mode or in the second heating mode, working fluid does not flow through any compressors or any expansion devices.

In this application, including the definitions below, the term "module" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C #, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A heat-pump system comprising:

a compressor;

an outdoor heat exchanger in fluid communication with the compressor;

an indoor heat exchanger in fluid communication with the compressor;

an expansion device in fluid communication with the indoor and outdoor heat exchangers; and a supplemental heater including a heat source and a working-fluid conduit, wherein the heat source is in a heat-transfer relationship with the working-fluid conduit such that the heat source is configured to heat the working-fluid conduit, and wherein the working-fluid conduit is disposed fluidly between the expansion device and the indoor heat exchanger such that the working fluid flows from the working-fluid conduit to the indoor heat exchanger without flowing through the compressor.

2. The heat-pump system of claim 1, further comprising a first reversing valve in fluid communication with the compressor, the expansion device, and the indoor and outdoor heat exchangers, wherein the first reversing valve is movable between a first position and a second position, wherein the first reversing valve is in the first position when the heat-pump system is in a heating mode, and wherein the first reversing valve is in the second position when the heat-pump system is in a cooling mode.

3. The heat-pump system of claim 2, wherein:

when the heat-pump system is operating in the heating mode, the indoor heat exchanger receives working fluid from the working-fluid conduit such that the working fluid flows from an outlet of the working-fluid conduit to an inlet of the indoor heat exchanger without flowing through any one or more of the compressor, the outdoor heat exchanger, and the expansion device, and when the heat-pump system is operating in the cooling mode, the indoor heat exchanger receives working fluid from the working-fluid conduit of the supplemental heater such that the working fluid flows from an outlet of the working-fluid conduit to an inlet of the indoor heat exchanger without flowing through any one or more of the compressor, the outdoor heat exchanger, and the expansion device.

4. The heat-pump system of claim 3, wherein working fluid flows through the indoor heat exchanger in the same direction in the heating and cooling modes, wherein working fluid flows through the outdoor heat exchanger in the same direction in the heating and cooling modes, wherein working fluid flows through the expansion device in the same direction in the heating and cooling modes, and wherein working fluid flows through the working-fluid conduit in the same direction in the heating and cooling modes.

5. The heat-pump system of claim 4, further comprising a second reversing valve in fluid communication with the compressor, the expansion device, and the indoor and outdoor heat exchangers, wherein the second reversing valve is movable between a first position and a second position, wherein the second reversing valve is in the first position when the heat-pump system is in the heating mode, and wherein the second reversing valve is in the second position when the heat-pump system is in the cooling mode.

6. The heat-pump system of claim 5, further comprising:

a first bypass flow path in selective fluid communication with the first and second reversing valves;

a first bypass valve fluidly connected to the first bypass flow path and movable between a first position in which fluid flow through the first bypass flow path is restricted and fluid flow to a suction inlet of the compressor is allowed and a second position in which fluid flow through the first bypass flow path is allowed and fluid flow to the suction inlet of the compressor is restricted;

a second bypass flow path in selective fluid communication with the first and second reversing valves; and a second bypass valve fluidly connected to the second bypass flow path and movable between a first position in which fluid flow through the second bypass flow path is restricted and fluid flow through the expansion device is allowed and a second position in which fluid flow through the second bypass flow path is allowed and fluid flow through the expansion device is restricted.

7. The heat-pump system of claim 6, wherein the second bypass flow path includes a pump that operates when the second bypass valve is in the second position.

8. The heat-pump system of claim 1, further comprising another indoor heat exchanger, wherein the working-fluid conduit of the supplemental heater is disposed fluidly between the indoor heat exchangers.

9. The heat-pump system of claim 1, further comprising a control module configured to control operation of the supplemental heater based on a temperature of working fluid flowing between the supplemental heater and the indoor heat exchanger.

10. The heat-pump system of claim 9, wherein the control module controls operation of the supplemental heater based on an outdoor ambient air temperature.

11. The heat-pump system of claim 10, wherein the control module controls operation of the supplemental heater based on fluctuations in a cost of electrical energy.

12. A heat-pump system comprising:

a compressor;

an outdoor heat exchanger in fluid communication with the compressor;

an indoor heat exchanger in fluid communication with the compressor;

an expansion device in fluid communication with the indoor and outdoor heat exchangers;

a first reversing valve having a first inlet, a second inlet, a first outlet, and a second outlet, wherein the first inlet of the first reversing valve is fluidly connected with a discharge outlet of the compressor, the second inlet of the first reversing valve is fluidly connected with an outlet of the expansion device, the first outlet of the first reversing valve is fluidly connected with an inlet of the outdoor heat exchanger, and the second outlet provides working fluid to the indoor heat exchanger;

a second reversing valve having a first inlet, a second inlet, a first outlet, and a second outlet, wherein the first inlet of the second reversing valve is fluidly connected with an outlet of the outdoor heat exchanger, the second inlet of the second reversing valve is fluidly connected with an outlet of the indoor heat exchanger, the first outlet of the second reversing valve is fluidly connected with an inlet of the expansion device, and the second outlet provides working fluid to a suction inlet of the compressor; and a supplemental heater including a heat source and a working-fluid conduit, wherein the heat source is in a heat-transfer relationship with the working-fluid conduit such that the heat source is configured to heat the working-fluid conduit, and wherein the working-fluid conduit is disposed fluidly between the expansion device and the indoor heat exchanger.

13. The heat-pump system of claim 12, further comprising:

a first bypass flow path in selective fluid communication with the first and second reversing valves;

a first bypass valve fluidly connected to the first bypass flow path and movable between a first position in which fluid flow through the first bypass flow path is restricted and fluid flow to a suction inlet of the compressor is allowed and a second position in which fluid flow through the first bypass flow path is allowed and fluid flow to the suction inlet of the compressor is restricted;

a second bypass flow path in selective fluid communication with the first and second reversing valves; and a second bypass valve fluidly connected to the second bypass flow path and movable between a first position in which fluid flow through the second bypass flow path is restricted and fluid flow through the expansion device is allowed and a second position in which fluid flow through the second bypass flow path is allowed and fluid flow through the expansion device is restricted.

14. The heat-pump system of claim 13, wherein the second bypass flow path includes a pump that operates when the second bypass valve is in the second position.

15. The heat-pump system of claim 14, wherein:

the first reversing valve is movable between a first position and a second position, and the second reversing valve is movable between a first position and a second position, when the first reversing valve is in its first position: (a) the first inlet of the first reversing valve is fluidly connected with the second outlet of the first reversing valve, and (b) the second inlet of the first reversing valve is fluidly connected with the first outlet of the first reversing valve, when the second reversing valve is in its first position: (a) the first inlet of the second reversing valve is fluidly connected with the second outlet of the second reversing valve, and (b) the second inlet of the second reversing valve is fluidly connected with the first outlet of the second reversing valve, when the first reversing valve is in its second position: (a) the first inlet of the first reversing valve is fluidly connected with the first outlet of the first reversing valve, (b) the second inlet of the first reversing valve is fluidly connected with the second outlet of the first reversing valve, and when the second reversing valve is in its second position: (a) the first inlet of the second reversing valve is fluidly connected with the first outlet of the second reversing valve, and (b) the second inlet of the second reversing valve is fluidly connected with the second outlet of the second reversing valve.

16. The heat-pump system of claim 15, wherein:

the heat-pump system is operable in a first heating mode, a cooling mode, a defrost mode, and a second heating mode, in the first heating mode: (a) the first and second reversing valves are in their first positions, (b) the first and second bypass valves are in their first positions, (c) the pump is shutdown, and (d) the compressor is operating, in the cooling mode: (a) the first and second reversing valves are in their second positions, (b) the first and second bypass valves are in their first positions, (c) the pump is shut down, and (d) the compressor is operating, in the defrost mode: (a) the first and second reversing valves are in their first positions, (b) the first and second bypass valves are in their second positions, (c) the pump is operating, and (d) the compressor is shut down, and in the second heating mode: (a) the first reversing valve is in its second position, (b) the second reversing valve is in its first position, (c) the second bypass valve is in its second position, (c) the pump is operating, and (d) the compressor is shut down.

17. The heat-pump system of claim 16, further comprising a control module configured to control operation of the supplemental heater, wherein the control module selectively operates the supplemental heater when the heat-pump system is operating in the first heating mode, the defrost mode, and the second heating mode.

18. The heat-pump system of claim 17, wherein:

working fluid flows through the indoor heat exchanger in the same direction in the first heating mode, the cooling mode, the defrost mode, and the second heating mode, working fluid flows through the outdoor heat exchanger in the same direction in the first heating mode, the cooling mode, the defrost mode, and the second heating mode, working fluid flows through the expansion device in the same direction in the first heating mode, the cooling mode, the defrost mode, and the second heating mode, and working fluid flows through the working-fluid conduit in the same direction in the first heating mode, the cooling mode, the defrost mode, and the second heating mode.

19. The heat-pump system of claim 17, wherein the control module controls operation of the supplemental heater based on a temperature of working fluid flowing between the supplemental heater and the indoor heat exchanger.

20. The heat-pump system of claim 19, wherein the control module controls operation of the supplemental heater based on an outdoor ambient air temperature.

21. The heat-pump system of claim 20, wherein the control module controls operation of the supplemental heater based on fluctuations in a cost of electrical energy.

22. The heat-pump system of claim 12, further comprising another indoor heat exchanger, wherein the working-fluid conduit of the supplemental heater is disposed fluidly between the indoor heat exchangers.

* * * * *